US007257969B2

(12) United States Patent
Kim et al.

(10) Patent No.: US 7,257,969 B2
(45) Date of Patent: Aug. 21, 2007

(54) APPARATUS FOR SUPPLYING DETERGENT IN WASHER

(75) Inventors: Jong Seok Kim, Changwon-shi (KR); Yang Hwan No, Changwon-shi (KR); Han Ki Cho, Changwon-shi (KR); Yeon Su Jung, Changwon-shi (KR); Jung Hoon Kang, Changwon-shi (KR); Myung Sik Park, Changwon-shi (KR); Young Hoon Ha, Masan-shi (KR)

(73) Assignee: LG Electronics Inc., Seoul (KR)

( * ) Notice: Subject to any disclaimer, the term of this patent is extended or adjusted under 35 U.S.C. 154(b) by 613 days.

(21) Appl. No.: 10/471,336

(22) PCT Filed: Jan. 10, 2003

(86) PCT No.: PCT/KR03/00050

§ 371 (c)(1),
(2), (4) Date: Sep. 10, 2003

(87) PCT Pub. No.: WO03/057970

PCT Pub. Date: Jul. 17, 2003

(65) Prior Publication Data

US 2005/0097925 A1 May 12, 2005

(30) Foreign Application Priority Data

| | | |
|---|---|---|
| Jan. 11, 2002 | (KR) | 10-2002-0001724 |
| Jan. 11, 2002 | (KR) | 10-2002-0001725 |
| Jan. 11, 2002 | (KR) | 10-2002-0001726 |
| Jan. 11, 2002 | (KR) | 10-2002-0001727 |
| Jan. 11, 2002 | (KR) | 10-2002-0001728 |
| Jan. 11, 2002 | (KR) | 10-2002-0001731 |
| Jan. 11, 2002 | (KR) | 10-2002-0001737 |
| Jul. 11, 2002 | (KR) | 10-2002-0040247 |
| Sep. 3, 2002 | (KR) | 10-2002-0052976 |

(51) Int. Cl.
*D06F 29/00* (2006.01)

(52) U.S. Cl. ..... 68/17 R

(58) Field of Classification Search ..... 68/12, 68/17 R, 18, 207, 268; 134/93, 101
See application file for complete search history.

(56) References Cited

U.S. PATENT DOCUMENTS

| | | | | |
|---|---|---|---|---|
| 3,988,908 | A * | 11/1976 | Beare et al. | 68/12.18 |
| 4,118,957 | A * | 10/1978 | Marcussen | 68/17 A |
| 4,188,807 | A * | 2/1980 | Graf et al. | 68/17 R |
| 4,467,627 | A * | 8/1984 | Platt et al. | 68/17 R |
| 4,490,862 | A * | 1/1985 | Vidal | 4/292 |
| 4,700,554 | A * | 10/1987 | Eichman et al. | 68/17 R |
| 5,306,421 | A * | 4/1994 | Weinstein | 210/151 |
| 5,641,947 | A * | 6/1997 | Riddle, Jr. | 177/126 |
| 5,759,398 | A * | 6/1998 | Kielbowicz | 210/416.1 |
| 6,000,248 | A * | 12/1999 | Erickson et al. | 68/17 R |
| 6,311,701 | B1 * | 11/2001 | Yuhara et al. | 132/294 |
| 6,434,977 | B1 * | 8/2002 | Hapke et al. | 68/17 R |

FOREIGN PATENT DOCUMENTS

| | | |
|---|---|---|
| DE | 1246655 | * 8/1967 |
| JP | 55-053084 | 10/1978 |
| JP | 57-36565 | 3/1982 |
| JP | 03-173599 | 7/1991 |
| JP | 04-282198 | 10/1992 |

OTHER PUBLICATIONS

Translation of Grunow from http://babelfish.altavista.com/.*
International Search Report; Mar. 24, 2003; Austrian Patent Office; 2 pages.

* cited by examiner

*Primary Examiner*—Michael Barr
*Assistant Examiner*—Jason Heckert
(74) *Attorney, Agent, or Firm*—McKenna Long & Aldridge LLP

(57) ABSTRACT

The invention relates to a detergent supplying apparatus in a washer which includes a cabinet (1), a drum (4) rotatably provided in the cabinet and a tub (3) fixed outside the drum (4). The detergent supplying apparatus includes: a water feed pipe (21) for feeding water; a detergent container (100) including water storage pool (104) having water inlet opening (141) connected to the water feed pipe, for being supplied with water through the water inlet opening (141), detergent pool (101 to 103) dividedly formed at a side of the water storage pool (104 to 106) by overflow compartments (108 to 110), for storing detergent, and drain (107) provided at a passage end of the detergent pools (104 to 106), whereby the water fed to the water storage pools (104 to 106) overflows the overflow compartments (108 to 110) to be fed to the detergent pools (101 to 103), and discharges through the drain (107); and detergent discharge pipe (25) of which one end is connected to the drain of the detergent container and the other end is connected to the tub of the washer, for guiding the detergent and water discharged through the drain into the tub.

68 Claims, 19 Drawing Sheets

APPARATUS FOR SUPPLYING DETERGENT IN WASHER

TECHNICAL FIELD

The present invention relates to an apparatus for supplying detergent in a washer, and more particularly; to a detergent supplying apparatus in which detergent feeds into a tub while water fed into the detergent container flows down along the wall of the detergent container in an overflowing manner.

BACKGROUND ART

A washer is generally an apparatus for cleaning the laundry via washing, rinsing and dewatering in order to separate dirt from clothes, bedding and so on using the operation of water.

Since it is difficult to input a proper quantity of detergent and the laundry may be discolored when detergent is directly inputted into a drum of the washer, an additional detergent supplying apparatus conventionally has been installed in an upper portion of the washer to feed and store water in a tub together with detergent since Such a conventional detergent supplying apparatus injects water through a nozzle in an upper portion of a detergent container in a showering or injecting fashion, in which injected water is mixed with detergent in the detergent container and then stored in the tub.

In the conventional detergent supplying apparatus as above, since water is injected in the showering or direct injecting fashion when it is fed into the detergent container, a portion of detergent remains on a wall or in a corner of the detergent container. As a result, a certain quantity of detergent is not used in washing and water is splashed together with detergent thereby making surroundings of the washer dirty.

Furthermore, the conventional detergent supplying apparatus is disadvantageously sophisticated in design since the detergent container is installed in the upper portion of the washer to be inserted and drawn out like a drawer in order to input detergent and a water injecting section is divided from a detergent supplying section.

DISCLOSURE OF THE INVENTION

Accordingly, the present invention is directed to a detergent supplying apparatus in a washer that substantially obviate one or more of the problems due to limitations and disadvantages of the related art.

An object of the present invention is to provide a detergent supplying apparatus in a washer, which has a simple construction and can precisely regulate the quantity of detergent while ensuring surroundings clean.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, there is provided a detergent supplying apparatus in a washer including a cabinet, a drum rotatably provided in the cabinet and a tub fixedly installed outside the drum. The apparatus includes: a water feed pipe for feeding water; a detergent container including a water storage pool having a water inlet opening connected to the water feed pipe, for being supplied with water through the water inlet opening, a detergent pool dividedly formed at a side of the water storage pool by an overflow compartment, for storing detergent, and a drain provided at a passage end of the detergent pool, whereby the water fed to the water storage pool overflows the overflow compartment to be fed to the detergent pool, and then discharges through the drain; and a detergent discharge pipe of which one end is connected to the drain of the detergent container and the other end is connected to the tub of the washer, for guiding the detergent and water discharged through the drain into the tub.

In another aspect of the invention, the detergent pool is separately partitioned into three parts of first to third detergent pools, in sequence on the basis of the drain of the detergent container.

Preferably, the first and second detergent pools define a U-shaped passage with two U-shaped overflow compartments, and wherein the water storage pool is separately partitioned into first to third water storage pools by a plurality of partitions which extend from one end of the water storage pool to ends of the overflow compartments, the first water storage pool corresponding to the first detergent pool, the second water storage pool corresponding to the second detergent pool, and the third storage pool corresponding to the third detergent pool.

According to the present invention as set forth above, water primarily feeds into the water storage pools, flows over the overflow compartments, and then feed into the detergent pools to discharge detergent toward the tub so that water can feed detergent without splash and thus enable detergent to be used in a fixed quantity.

In a further another aspect of the invention, the detergent supplying apparatus may further comprise a box seating section provided integral with a portion of the detergent pool; and a detachable additive supplying box seated on the box seating section, by which additive such as tanning agent or bleaching agent can be supplied into the additive supplying box.

In still another aspect of the invention, the detergent supplying apparatus may further comprise a condensing pool provided in a corner portion of the detergent container and divided from the water storage pool and the detergent pool via the compartment; and a guide duct having one end connected to the tub and the other end connected to the condensing pool, for guiding air from the tub to the condensing pool.

In the above detergent supplying apparatus, air is discharged from the tub via the guide duct to the condensing pool so that water or detergent can be efficiently fed into the tub.

In a yet another aspect of the invention, the detergent supplying apparatus may further comprise a liquid detergent supplying means provided in one side of the detergent container, for automatically supplying liquid detergent into the detergent pool, wherein the liquid detergent supplying means includes: a feed hole provided in a bottom of the detergent pool; a storage tank for storing liquid detergent; a pump for pumping liquid detergent from the liquid detergent storage tank to the feed hole; an adapter for connecting the feed hole and the pump; and a check valve provided in the adapter, for regulating flow from the detergent pool toward a lower portion of the feed hole.

As set forth above, the present invention has an advantage that liquid can be efficiently and readily fed into the detergent container of the detergent supplying apparatus.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Figure 1:
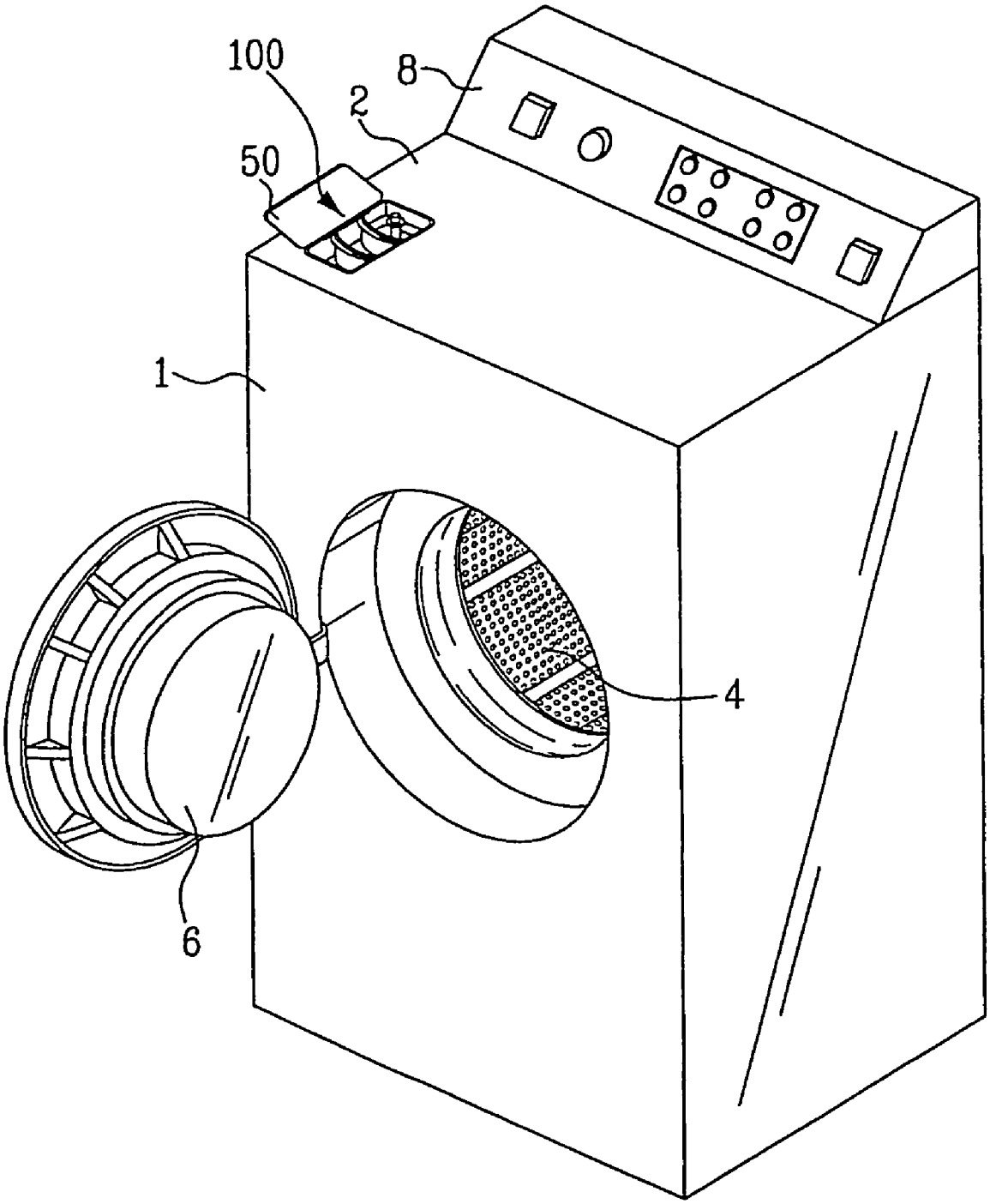
FIG. 1 is a perspective view of a washer illustrating a detergent supplying apparatus of the invention.

Reference will now be made in detail to the preferred embodiments of the present invention, examples of which are illustrated in the accompanying drawings, in which the same terms and reference numerals are used to designate the same or similar components and additional description thereof will be omitted hereinafter.

Figure 2:
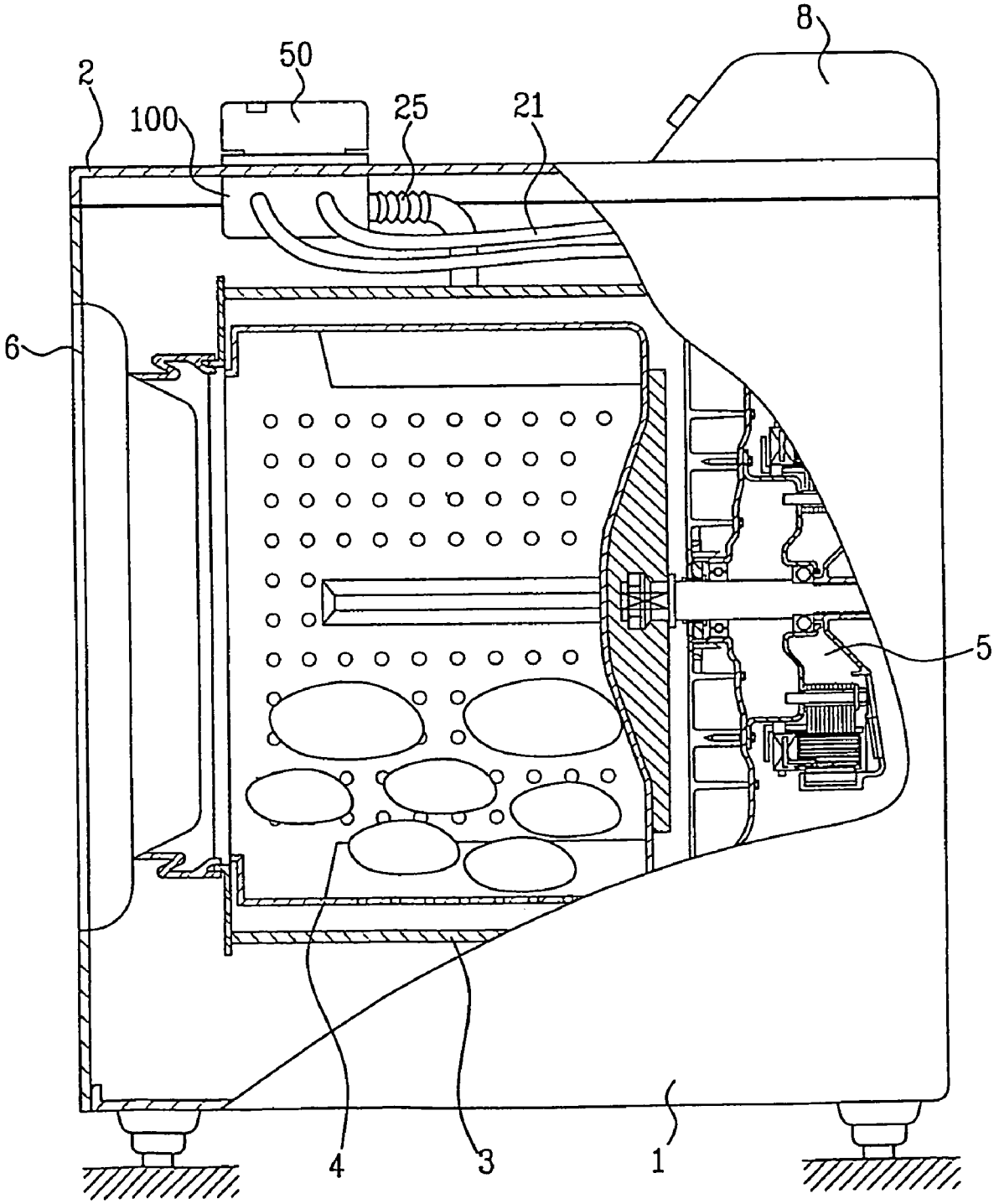
FIG. 2 is a partially broken sectional view illustrating important parts of the washer in FIG. 1.
Figure 3:
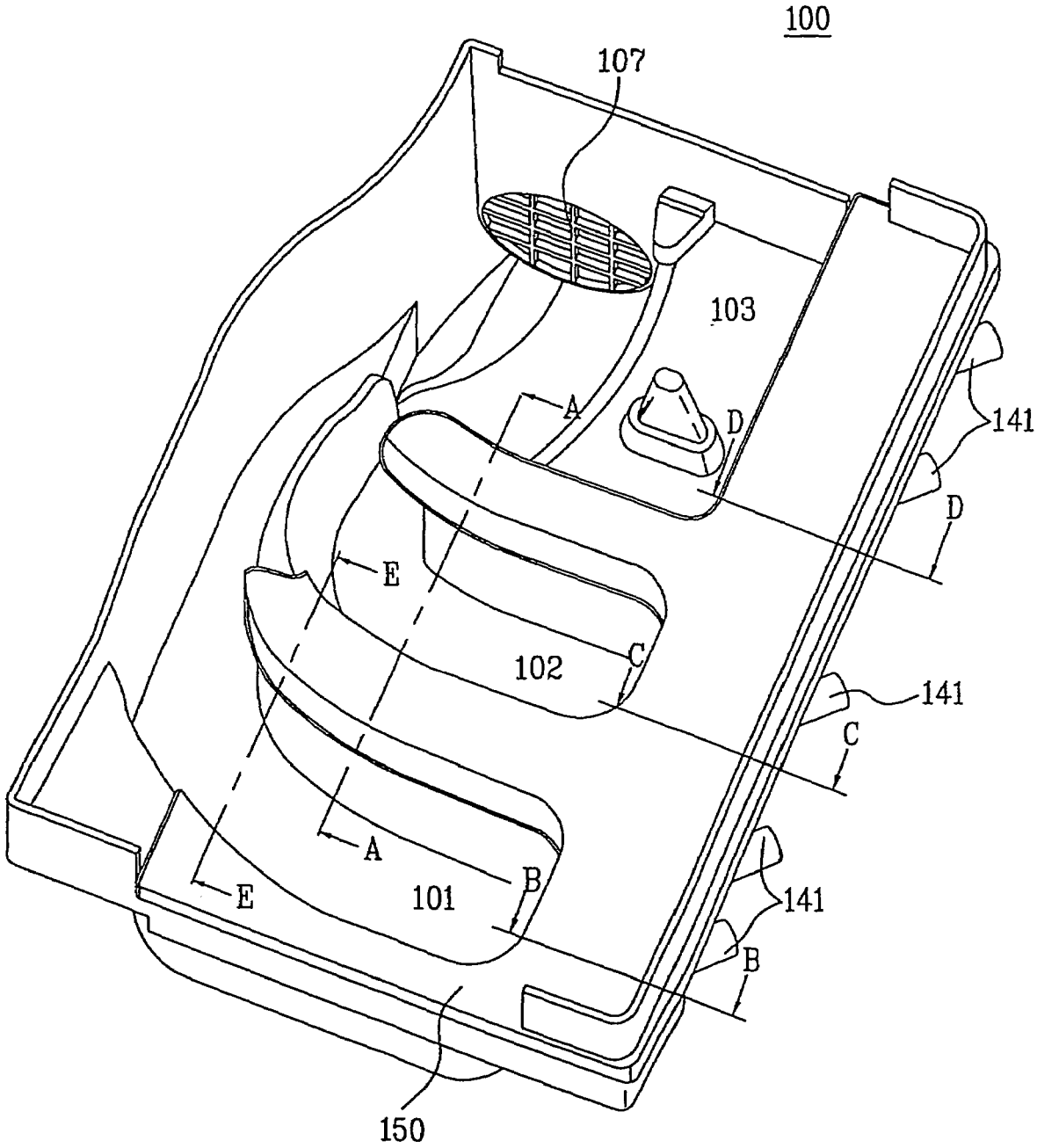
FIG. 3 is a perspective view of a detergent supplying apparatus according to a preferred embodiment of the invention.
Figure 4:
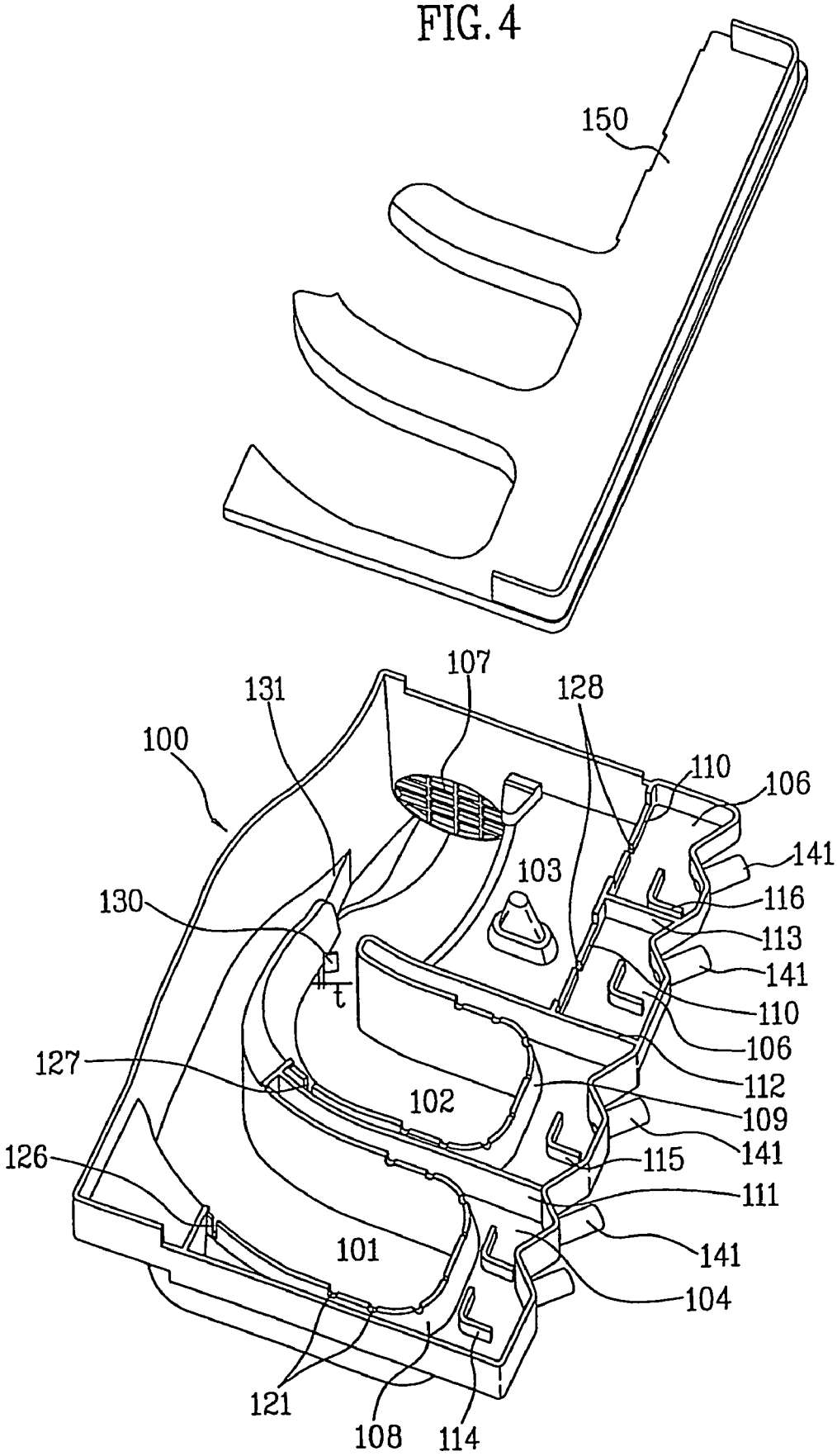
FIG. 4 is an exploded perspective view of the detergent supplying apparatus in FIG. 4.
Figure 5:
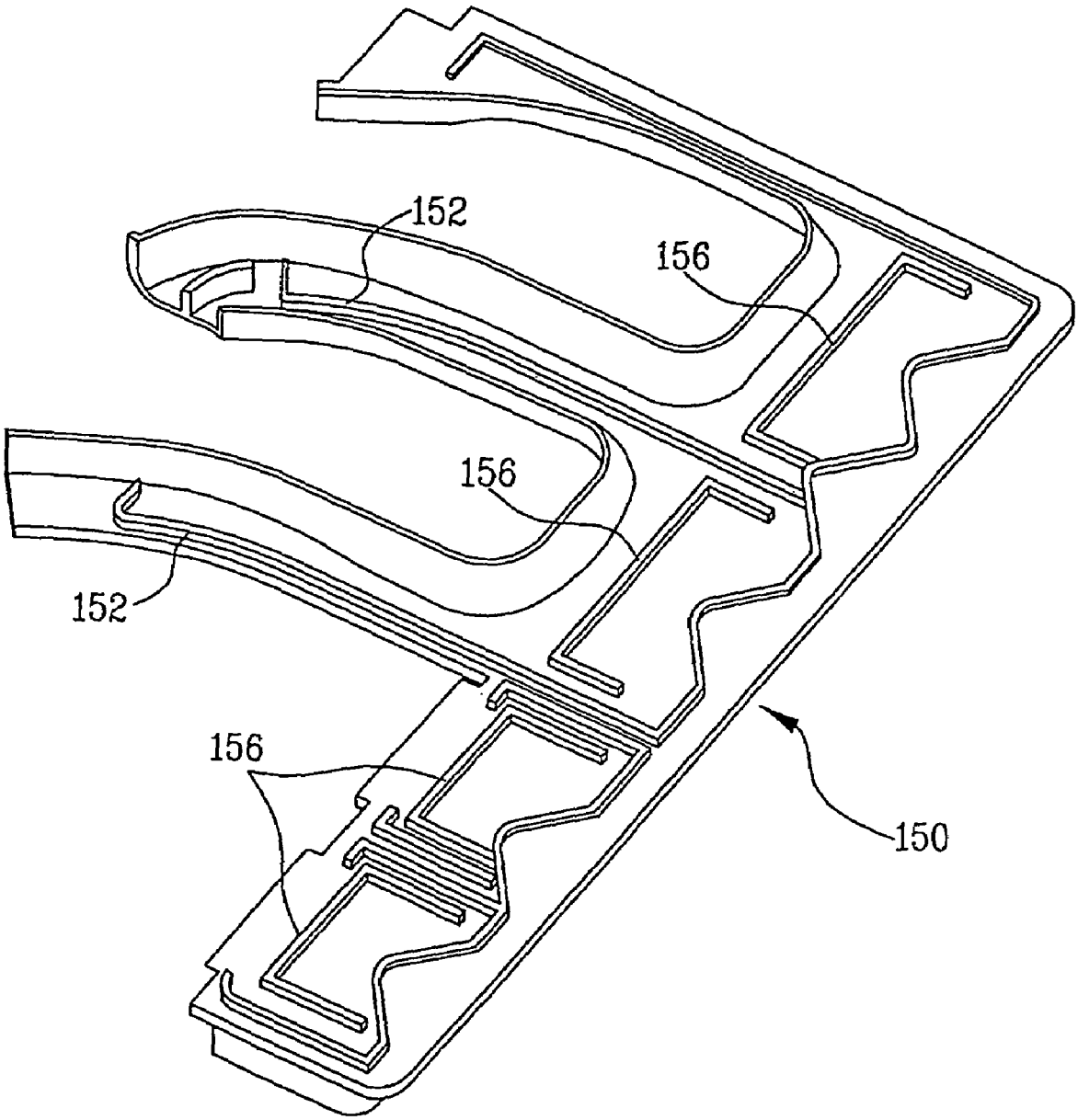
FIG. 5 is a perspective view of a lower portion of a pool cover of the detergent supplying apparatus in FIG. 3.
Figure 6:
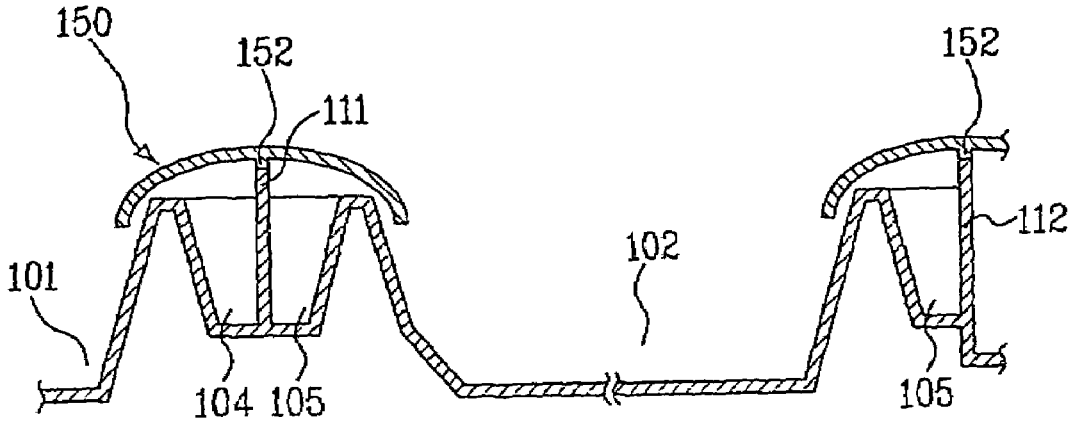
FIG. 6 is a sectional view along A-A line in FIG. 3.
Figure 7:
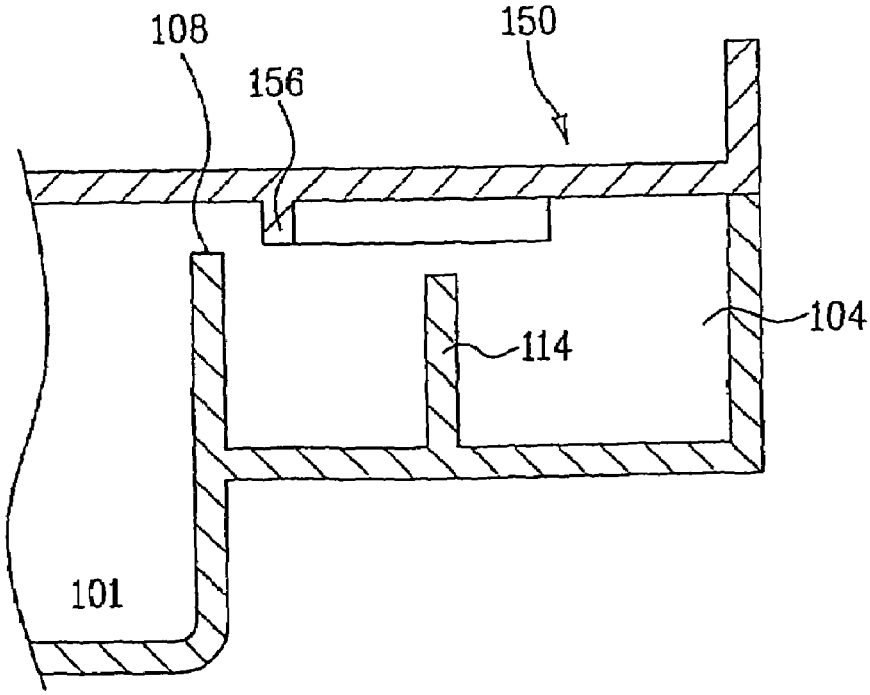
FIG. 7 is a sectional view along B-B line in FIG. 3.
Figure 8:
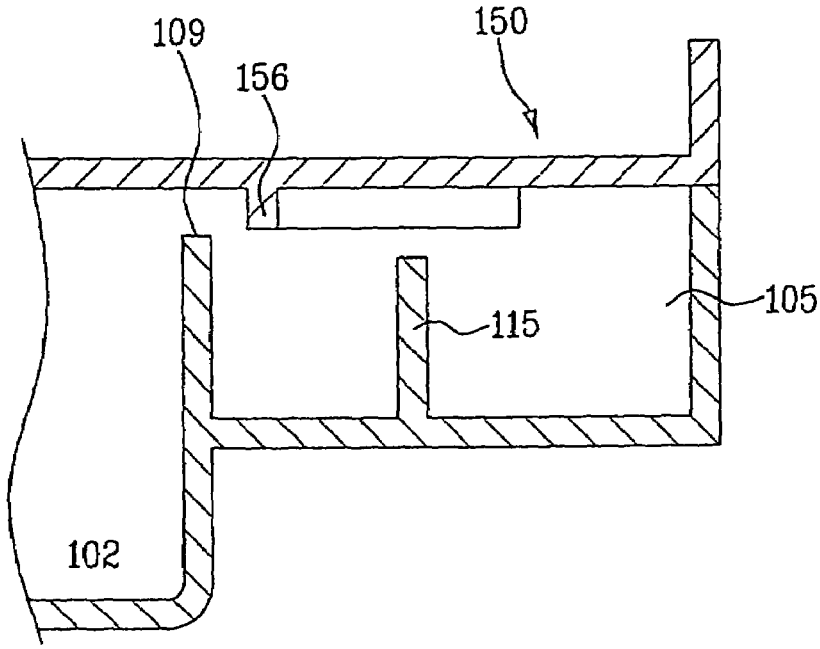
FIG. 8 is a sectional view along C-C line in FIG. 3.
Figure 9:
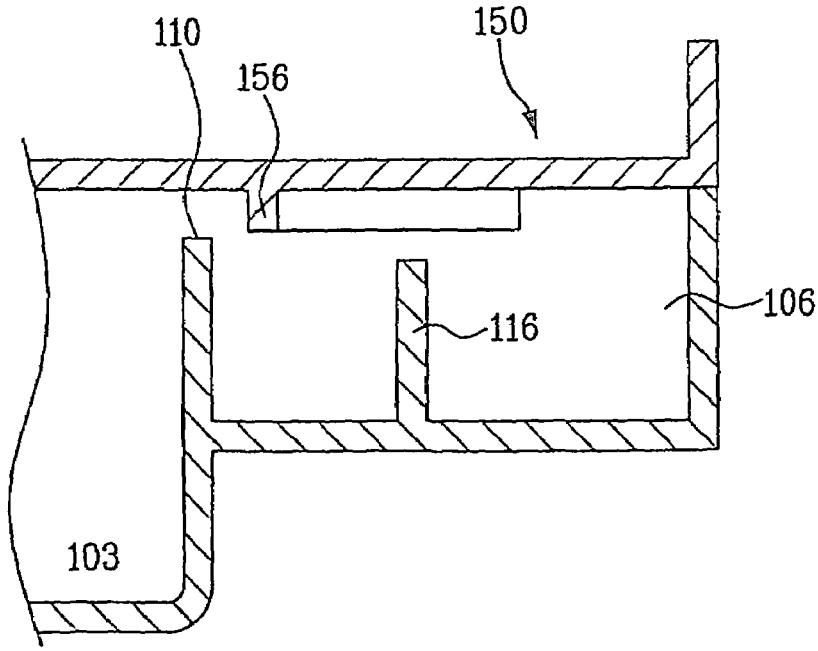
FIG. 9 is a sectional view along D-D line in FIG. 3.
Figure 10:
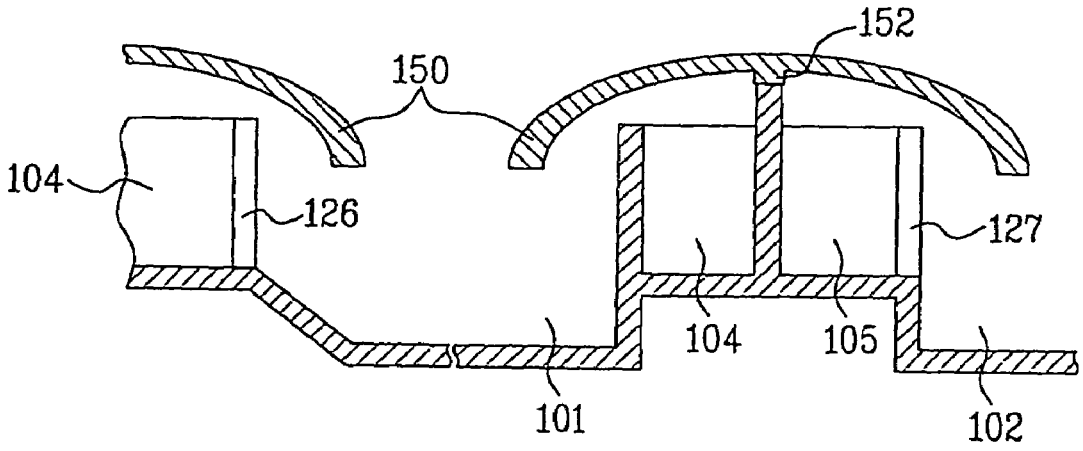
FIG. 10 is a sectional view along E-E line in FIG. 3.

FIGS. 1 and 2 illustrate a construction of a washer adopting a detergent supplying apparatus of the invention, in which a door 6 for allowing input and output of the laundry is pivotably mounted on a central front portion of a cabinet 1, a tub 3 for containing washing water is supported by a damper (not shown) and a spring (not shown) within the cabinet 1, a drum 4 for containing the laundry is rotatably arranged within the tub 3, and a drive motor 5 for rotating the drum 4 is installed in a rear portion within the cabinet 1.

The cabinet l also comprises a top plate 2 which constitutes an upper plane of the cabinet 1. Top plate 2 has a control panel 8 mounted on a rear portion of the top plate 2 for operation of the washer, a detergent container 100 for mixing and dispensing fed water with powder detergent and tanning agent, and a lid 50 for opening/closing the detergent container 100. The detergent container 100 is connected with a water feed pipe 21 for feeding washing water into the detergent container 100 and an inlet bellows pipe 25 for guiding detergent and washing water mixed in the container 100 into the tub 3.

FIGS. 3 to 10 are detailed views of a detergent supplying apparatus according to a preferred embodiment of the invention. The box-shaped detergent container 100 with an upper plane being opened has first to third water storage pools 104 to 106 partitioned by two linear partitions 111 and 112. The detergent container 100 also has a main detergent pool 101, a preliminary detergent pool 102 and an additive pool 103 are partitioned via substantially U-shaped two overflow walls or compartments 108 and 109 and a linear overflow compartment 110 in rear portions of the water storage pools 104, 105 and 106. The detergent pools 101 to 103 respectively have passage ends which converge toward a drain 107 in the detergent container 100. The drain 107 is connected to the inlet bellows pipe 25 and provided with a net-shaped feed hole member by which the drain 107 can filter foreign materials from water and detergent in discharge.

Here, a step 131 is formed to make the passage end of the main detergent pool 101 higher than that of the preliminary detergent pool 102 so that water and detergent discharged via the preliminary detergent pool 102 does not reflow toward the main detergent pool 101.

Preferably, the first to third water storage pools 104 to 106 are respectively connected to the water feed pipe 21 so that the water storage pools 104 to 106 respectively receive water via the water feed pipe 21.

L-shaped dispersion ribs 114 to 116 are respectively projected from bottoms of the first to third water storage pools 104 to 106 to disperse water fed via water inlet openings 141 in lateral and upward directions, thereby preventing eddy flow in the main, preliminary and additive pools 101 to 103.

The overflow compartments 108 to 110 are respectively provided at upper ends thereof with a plurality of slits 121, 122 and 128 to certain depths so that water may readily feed to the detergent pools 101 to 103 in the rear of the overflow compartments 108 to 110 even though water is fed at a low hydraulic pressure.

Also, the overflow compartments 108 and 109 are respectively provided at ends thereof with slits 126 and 127 which are cut out from the upper ends to lower ends of the overflow compartments 108 and 109 so that the remaining quantity of water can be completely discharged into the main and preliminary detergent pools 101 and 102.

The slit 128 in the linear overflow compartment 110 is completely cut out from the upper end to a lower end of the overflow compartment 110, and thus also serves to discharge the remaining quantity of water.

A passage conversion protrusion 130 for converting the passage toward a region A where detergent is collected is formed at one side of the passage end of the preliminary detergent pool 102. Preferably, the passage conversion protrusion 130 has a gap t from the overflow compartment 109 which constitutes the preliminary detergent pool 102, by which the remaining amount of detergent can be washed from behind the passage conversion protrusion 130.

In the meantime, the detergent supplying apparatus of the invention further comprises a pool cover 150 for covering the water storage pools 104 to 106. The pool cover 150 has couple ribs 152 at a lower portion thereof, which are respectively coupled to upper ends of the partitions 111 and 112, so as to completely divide the first to third water storage pool 104 to 106 and the detergent pools 101 to 103 so that water or detergent does not mix into one of the water storage and detergent pools from adjacent ones.

The pool cover 150 also has anti-scattering ribs 156 in another lower portion thereof, which prevent water in the water storage pools 104 to 106 from scattering upward the overflowing compartments 108 to 110 rather than flowing over the overflowing compartments 108 to 110.

The anti-splashing ribs 156 are projected over the upper ends of the overflow compartments 108 to 110 so as to prevent water from directly dropping into the detergent pools 101 to 103 when water collides into the dispersion ribs 114 to 116, splashes upward, and flows along the lower portion of the pool cover 150.

Figure 11:
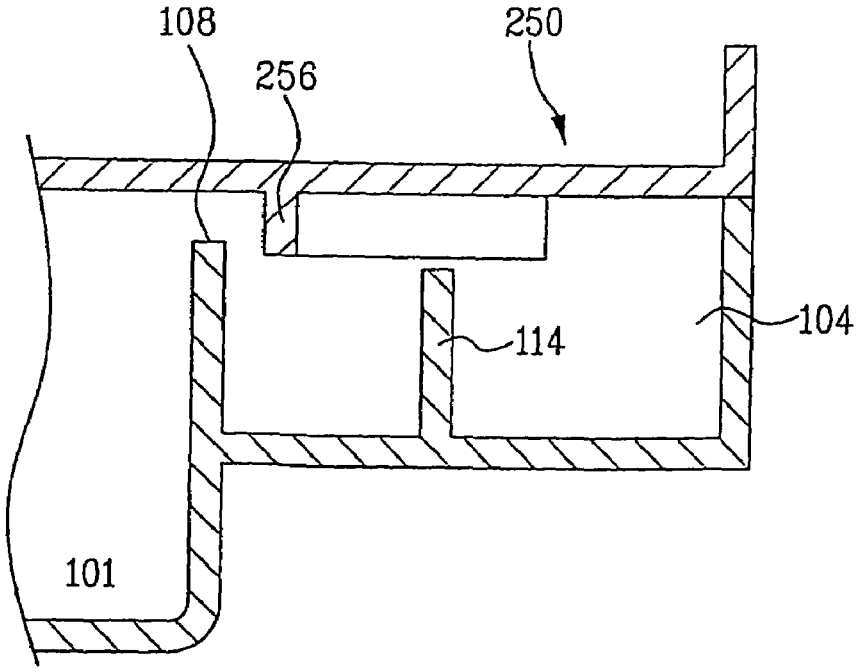
FIG. 11 is a sectional view of a detergent supplying apparatus according to an alternative embodiment of the invention corresponding to FIG. 7.

FIG. 11 illustrates a detergent supplying apparatus according to an alternative preferred embodiment of the invention, in which a distal end of an anti-scattering rib 256 of a pool cover 250 is projected under an upper end of an overflow compartment 108 so as to completely prevent water splashed in a water storage pool 104 from flowing along a lower portion of the pool cover 250.

The detergent supplying apparatus of the invention having one of the above constructions is operated as follows.

During preliminary washing, water is fed into the second water storage pool 105 through the water inlet opening-141, and fed water is stored in the second water storage pool 105 while being dispersed in lateral and upward directions via the dispersion rib 115.

When water stored in the second water storage pool 105 exceeds a certain quantity, stored water flows over the overflow compartment 109 to feed into the preliminary detergent pool 102, where it mixes with detergent stored therein, and then flows toward the downstream drain 107 along the wall of the overflow compartment 109.

Water flowing toward the drain 107 does not reflow into the main detergent pool 101 owing to the step 131 which is formed at the passage end of the main detergent pool 101, in which the passage conversion protrusion 130 introduces a portion of water to the region A where detergent is collected before water discharges via the drain 107.

Water and detergent discharged via the drain 107 is introduced along the inlet bellows pipe 25 into the tub 3 (refer to FIG. 2) where they are used for preliminary washing of the laundry.

Upon completing preliminary washing, main washing proceeds feeding water into the first water storage pool 104 through the water inlet openings 141. Water is stored in the first water storage pool 104 while being dispersed in lateral and upward directions via the dispersion ribs 114.

When water is stored in the first water storage pool 104 exceeding a certain quantity, stored water flows over the overflow compartment 108 and then to the drain 107 together with detergent stored in the main detergent pool 101. Water and detergent past the drain 107 flows along the inlet bellows pipe 25 and is stored within the tub 3.

Where additive such as tanning agent and bleaching agent is supplied, water is fed into the third storage pools 106 through the water inlet openings 141, and fed water is stored in the third water storage pools 106 while being dispersed via the dispersion ribs 116.

When water is stored in the third water storage pools 106 exceeding a certain quantity, stored water flows over the overflow compartment 110 to feed into the additive pool 103, and then discharges via the drain 107 together with tanning or bleaching agent stored in the additive pool 103.

Even though water is fed at a low hydraulic pressure into each of the water storage pools 104 to 106 via each of the water inlet openings 141, the slits 121, 122 and 128 respectively formed in the upper ends of the overflow compartments 108 to 110 ensure water to readily feed into each of the detergent pools 101 to 103.

Also, the remaining quantity of water is completely discharged into each of the detergent pools 101 to 103 from each of the water storage pools 104 to 106 via each of the slits 126 and 127 for drainage of the remaining water and the slits 128, which are respectively formed in the overflow compartments 108 to 110. As a result, this prevents that the remaining water rots in the water storage pools while the washer is not used for a long time. Also, this prevents the remaining water from freezing in winter and thus damaging the detergent container.

Figure 12:
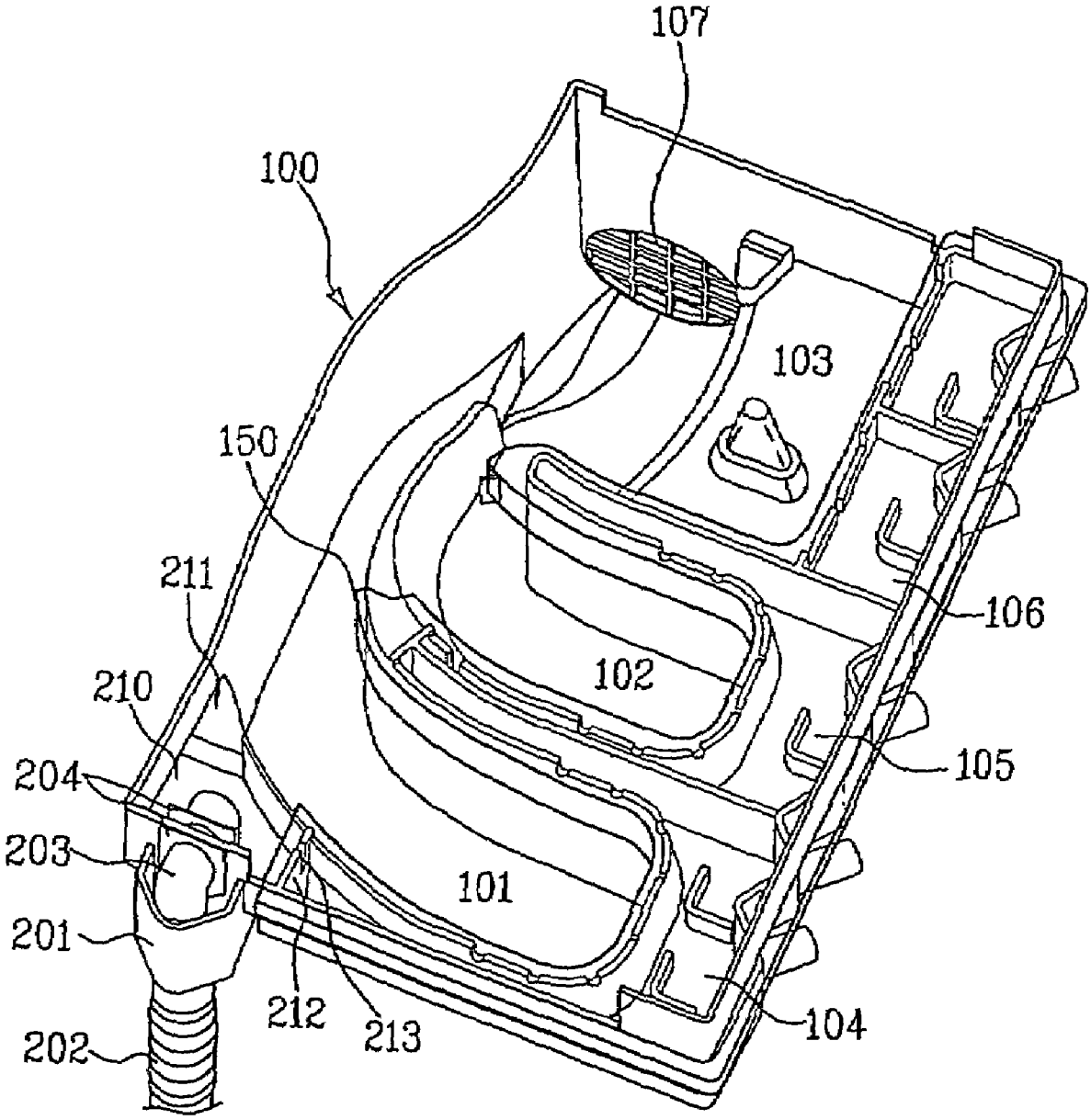
FIG. 12 is a perspective view of a detergent supplying apparatus according to another alternative embodiment of the invention.
Figure 13:
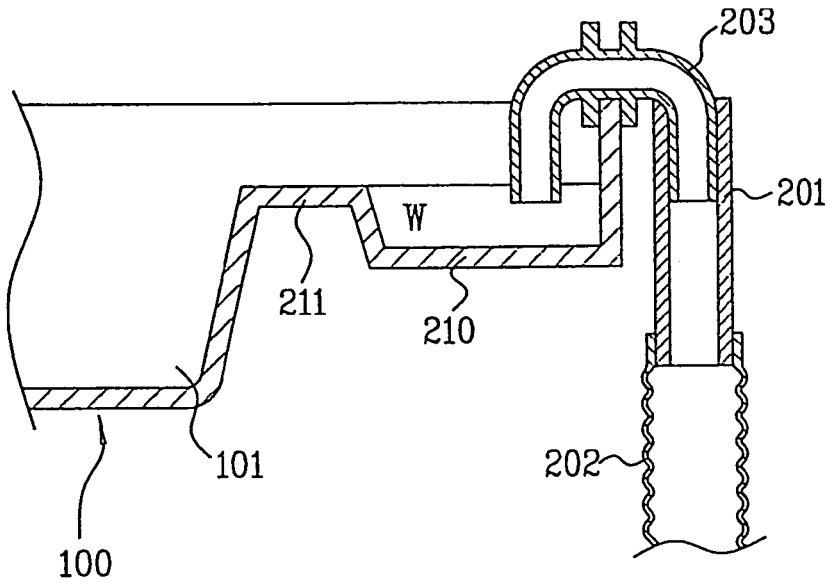
FIG. 13 is a sectional view of important parts of the detergent supplying apparatus in FIG. 12.

FIGS. 12 and 13 illustrate a detergent supplying apparatus according to another alternative embodiment of the invention. The detergent supplying apparatus of this embodiment is adapted to discharge air from the tub 3 (refer to FIG. 3) via a detergent container 100 in order to reduce the pressure in the tub 3 owing to feed of washing water while assisting washing water and detergent to readily feed into the tub 3.

Describing this embodiment in more detail, as shown in FIGS. 12 and 13, the detergent container 100 has a condensing pool 210 at a corner thereof, i.e., a portion of a main detergent pool 101 via a compartment 212. A water communication passage 211 is provided between the condensing pool 210 and the main detergent pool 101 so that water flows to the main detergent pool 101 via the communication passage 211 when water is stored in the condensing pool 210 by a certain quantity or more. The compartment 212 is provided with a slit 213 for feeding water so that water supplied to the first water storage pool 104 is fed to the condensing pool 210.

In the meantime, a connector 201 is fixedly installed in an outer portion of the detergent container 100 where the condensing pool 210 is provided. The connector 201 is connected by a lower end to one end of a vent bellows 202 which is connected by the other end to the tub 3. The connector 201 is connected by an upper end to one end of an air duct 203 for guiding air, which flows along the vent bellows 202, to the condensing pool 210. The air duct 203 is reversed U-shaped with the other end being placed just above the condensing pool 210.

The air duct 203 has two fitting projections 204 in a central portion in order to fixedly maintain the air duct 203 to the detergent container 100 by fitting a corner edge of the detergent container 100 into between the fitting projections 204.

In feeding water for washing or rinsing the laundry where water is fed via water inlet openings 141 as set forth in the foregoing embodiments, water floods from each of water storage pools 104 to 106 to each of detergent pools 101 to 103, where water mixes with detergent, and water and detergent discharges via a drain 107 to feed into the tub 3 via the inlet bellows pipe 25 while condensing water W is stored in the condensing pool 210. At this time, air is exhausted from the tub 3 via the vent bellows 202 as much as the volume of water and detergent which is fed via the inlet bellows pipe 25. Exhausted air passes through the air duct 203 and condensing water W, and then is discharged upward of the detergent container 100.

In boiling or drying the laundry, steam is introduced into condensing water W stored in the condensing pool 210 past the vent bellows 202 and the air duct 203 from the tub 3. Steam having at least a certain pressure level shoves condensing water W to discharge over the detergent container 100, whereas a portion of steam is condensed and stored in the condensing pool 210.

When at least a certain amount of water is stored in the condensing pool 210, water flows over via the communication passage 211 to the main detergent pool 101, from which water flows via the drain 107 and the inlet bellows pipe 25 into the tub 3.

Figure 14:
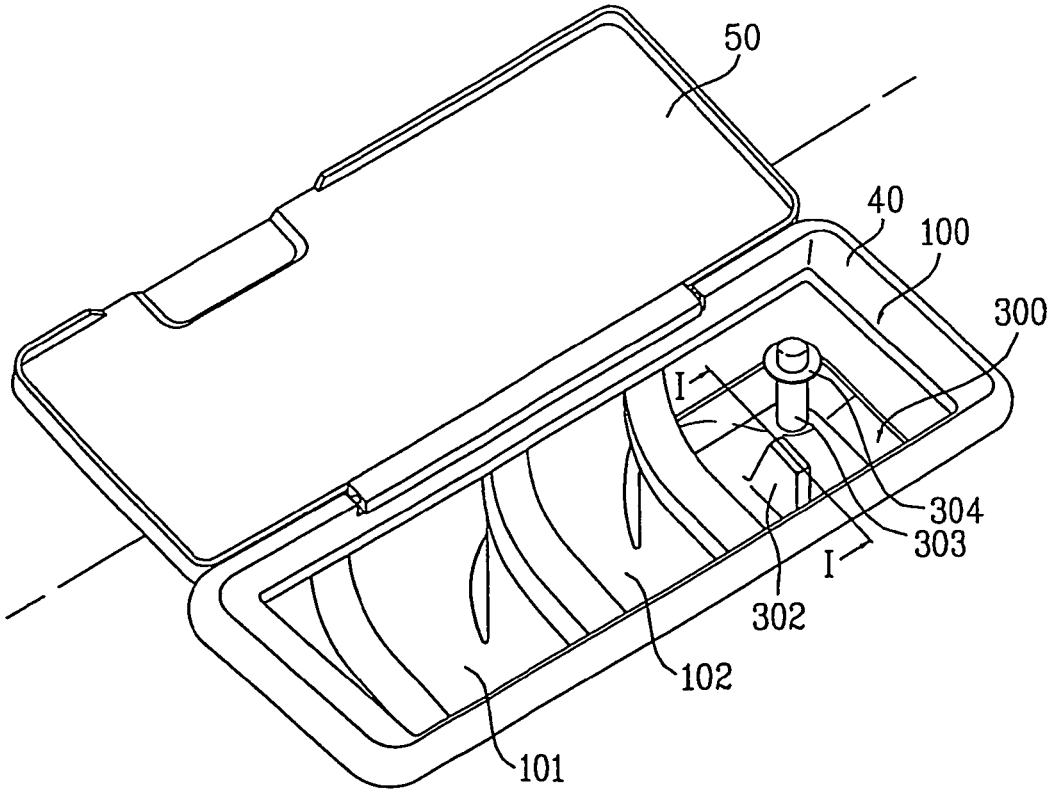
FIG. 14 is a perspective view of a detergent supplying apparatus according to further another alternative embodiment of the invention.
Figure 15:
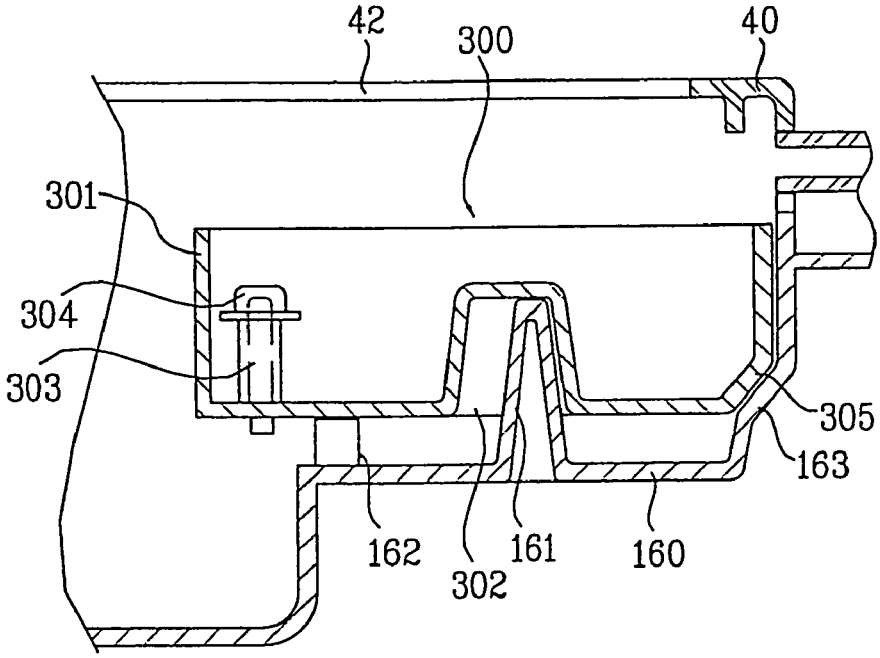
FIG. 15 is a sectional view along I-I line of the detergent supplying apparatus in FIG. 14.

FIGS. 14 and 15 illustrate a detergent supplying apparatus according to other alternative embodiment of the invention. The detergent supplying apparatus of this embodiment has a main detergent pool 101 and a preliminary detergent pool 102 which have similar configurations to those of the detergent supplying apparatuses according to the foregoing embodiments except that a box seating section 160 is formed in a lateral portion of the preliminary detergent pool 102. The box seating section 160 seats a separately detachable detergent supplying box 300 for storing additive such as tanning agent and bleaching agent.

A lid frame 40 is arranged along upper peripheries of the detergent container 100, and a lid 50 is pivotably mounted on a lateral portion of the lid frame 40 for opening/closing the detergent container 100.

The detergent supplying apparatus of this embodiment is adapted to feed water via flooding into the main detergent pool 101, the preliminary detergent pool 102 and the additive supplying box 300 like the detergent supplying apparatuses of the foregoing embodiments. As not shown in the drawings, in the detergent supplying apparatus of this embodiment, water storage pools and other components for flooding water to the detergent pools 101 and 102 and the additive supplying box 300 adopt the constructions of the water storage pools and the other components of the foregoing embodiments, in which detailed description thereof will be omitted hereinafter.

The additive supplying box 300 includes a body 301 with an opened upper portion for storing additive, a siphon tube 303 installed in a rear corner of the box main body 301 for discharging water and detergent to the outside from the main body 301 where water and detergent are mixed, and a siphon cover 304. The box main body 301 also has an insertion recess 302 in a lower central portion for fixing the box main body 301 on the box seating section 160.

A fixing protrusion 161 is formed on the box seating section 160, and when the additive supplying box 300 is seated on the box seating section 160, fits into the insertion recess 302 of the main body 301 to fix the additive supplying box 300. In addition, the fixing protrusion 161 has a width smaller than that of the insertion recess 302 so that the additive supplying box 300 can be readily seated.

When the fixing protrusion 161 is inserted into the insertion recess 302 to fix the box main body 301 on the box seating section 160, the box main body 301 advantageously maintains a gap from an upper face of the box seating section 160 to form a space between them regarding discharge of washing water and detergent. The box seating section 160 has a jaw 162 projected from a rear portion thereof for supporting a rear portion of the box main body 301 and a first inclined portion 163 formed in a front portion of the box seating section 160 for supporting a front portion of the box main body 301. The boxy main body 301 has a second inclined portion 305 formed corresponding to the first inclined portion 163 so that the second inclined portion 305 is seated on the first inclined portion 163.

It is preferred that the rear portion of the box main body 301 is further extended beyond the box seating section 160 so that the siphon tube 303 and the siphon cover 304 are placed beyond the box seating section. More preferably, the siphon tube 303 and the siphon cover 304 are placed in a rearmost portion of the main body 301.

Figure 16:
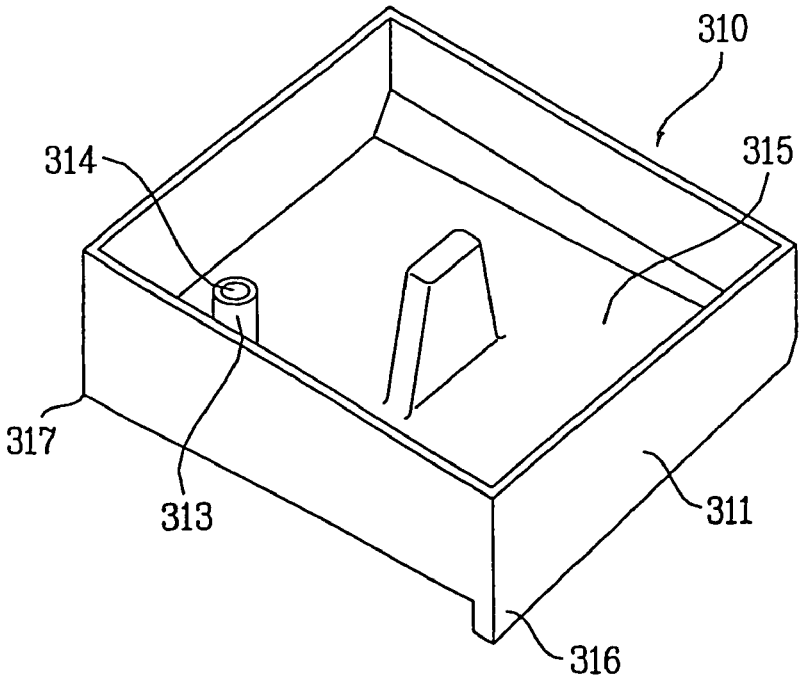
FIG. 16 is a perspective view of a detergent supplying apparatus according to other alternative embodiment of the invention.
Figure 17:
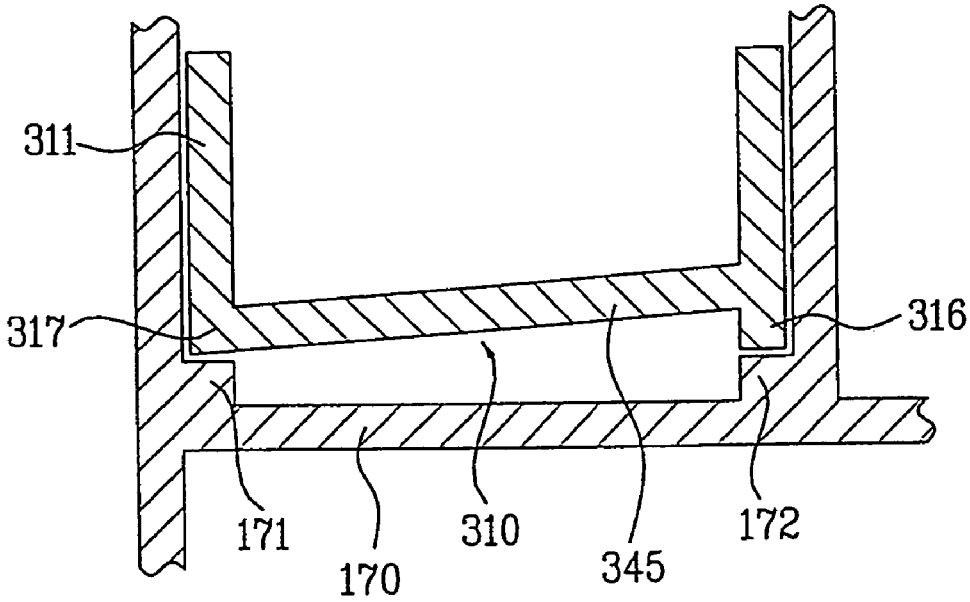
FIG. 17 is a sectional view of important parts of the detergent supplying apparatus in FIG. 16.

FIGS. 16 and 17 illustrate a detergent supplying apparatus according to a further another alternative embodiment of the invention. An additive supplying box 310 of this embodiment has a main body 311 with a downwardly inclined bottom 315, which is inclined downward in a diagonal direction toward a siphon hole 314 of a siphon tube 313 formed in a rear corner portion of the main body 311. A rib 316 is formed in the main body 311 opposite to the siphon hole 314 for compensating the inclination of the bottom 315 so that the main body 311 is placed on a box seating section 170.

The box body 131 maintains a horizontal position as a whole as an edge portion 317 thereof adjacent to the siphon hole 314 is supported on a first step 171, which is projected from a portion of the box seating section 170, and a lower portion of the inclination-compensating rib 316 is supported on a second step 172, which is projected opposite to the first step 171.

Since the bottom 315 of the main body 311 is inclined toward the siphon tube 313, the additive supplying box 310 has an advantage in that mixed fluid of water and detergent can be more readily discharged from the main body 311.

Figure 18:
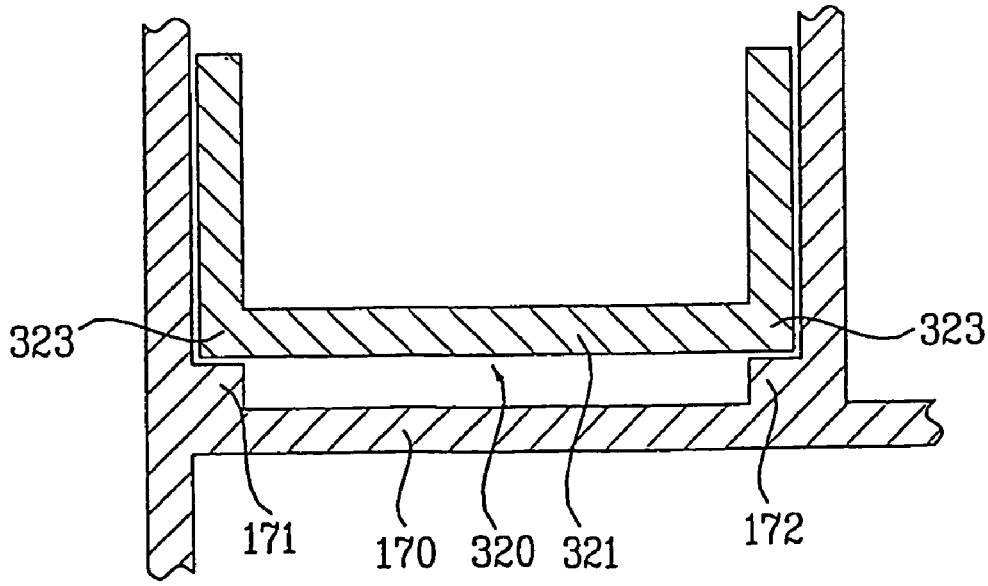
FIG. 18 is a sectional view of a detergent supplying apparatus according to further another alternative embodiment of the invention corresponding to FIG. 16.

Instead of inclining the bottom of the box body as set forth above, the bottom of the main body can alternatively have a horizontal configuration as shown FIG. 18, in which the main body 321 of the additive supplying box 320 can be fixed seated on the first and second steps 171 and 172 of the box seating section 170.

Figure 19:
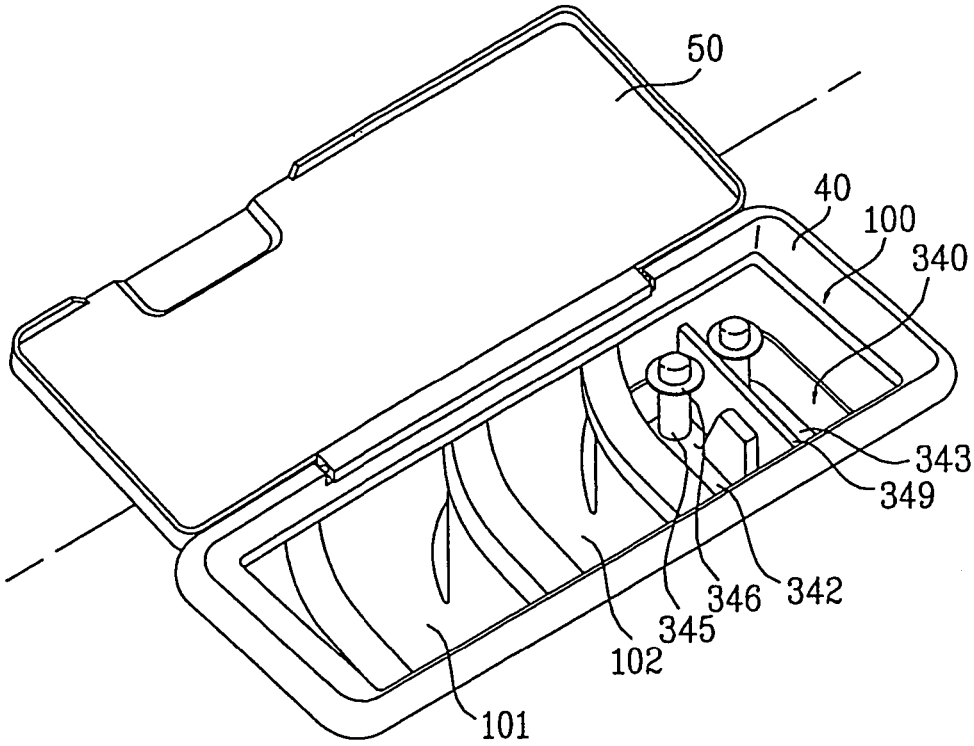
FIG. 19 is a perspective view of a detergent supplying apparatus according to other alternative embodiment of the invention.
Figure 20:
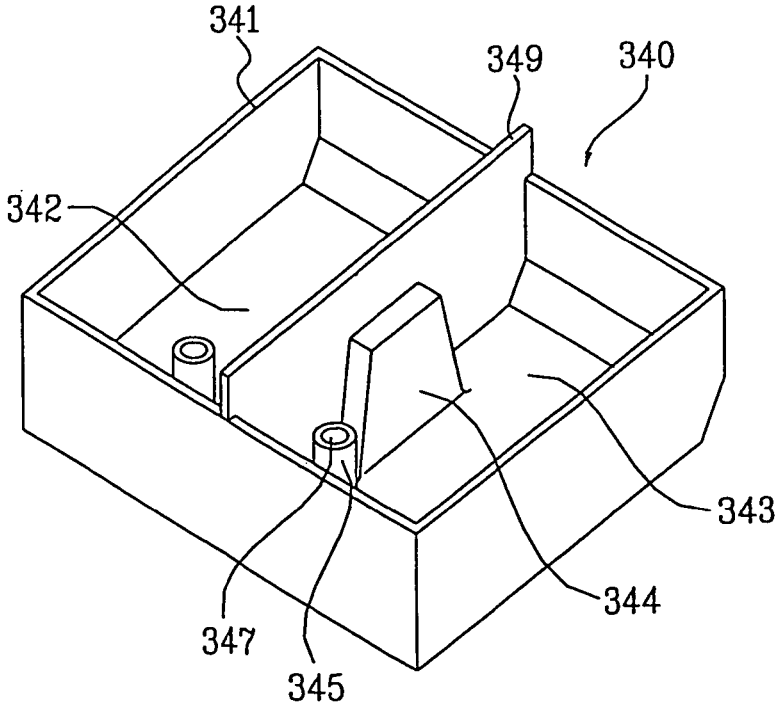
FIG. 20 is a perspective view of an additive supplying box of the detergent supplying apparatus in FIG. 19.
Figure 21:
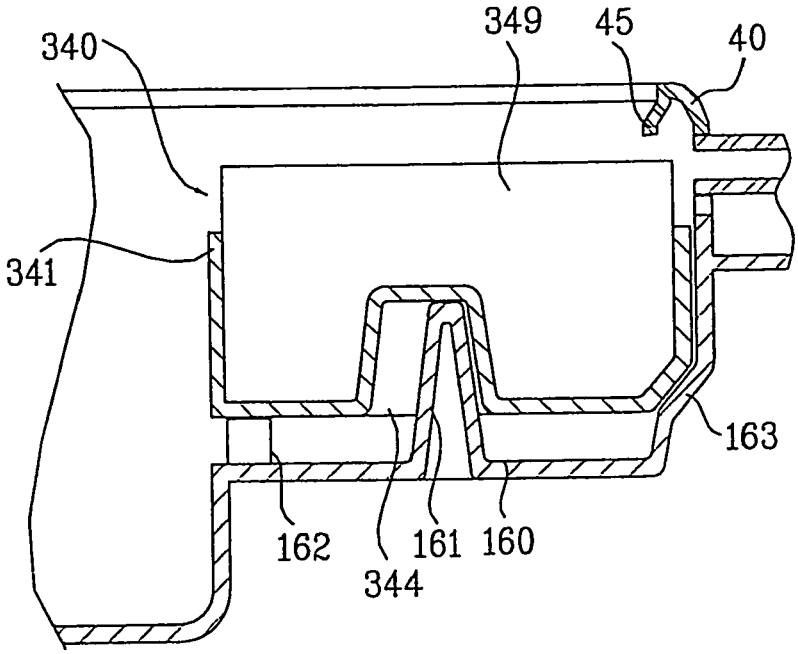
FIG. 21 is a sectional view of important parts of the detergent supplying apparatus in FIG. 19.
Figure 22:
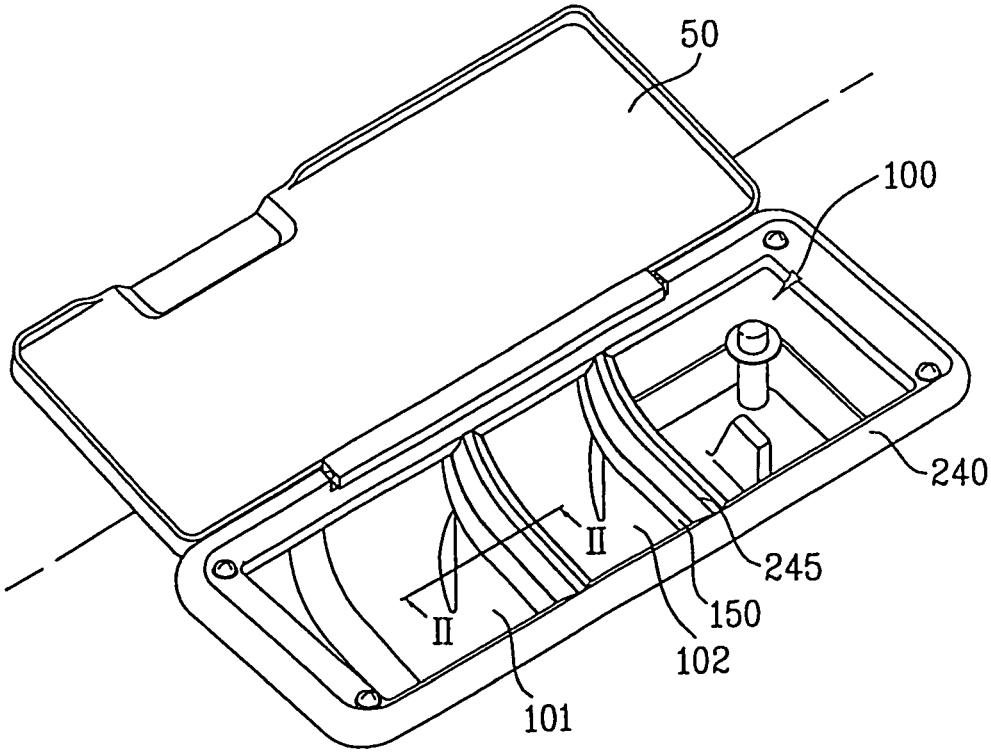
FIG. 22 is a perspective view of a preferred embodiment of a lid and a lid frame in a detergent supplying apparatus of the invention.
Figure 23:
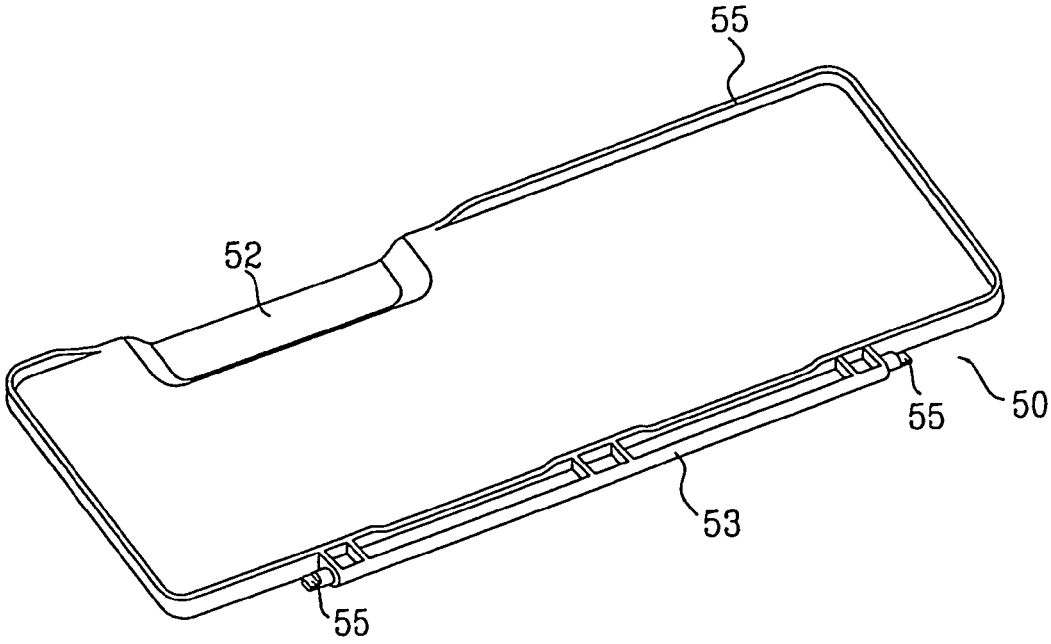
FIG. 23 is a perspective view of the lid in FIG. 22.
Figure 24:
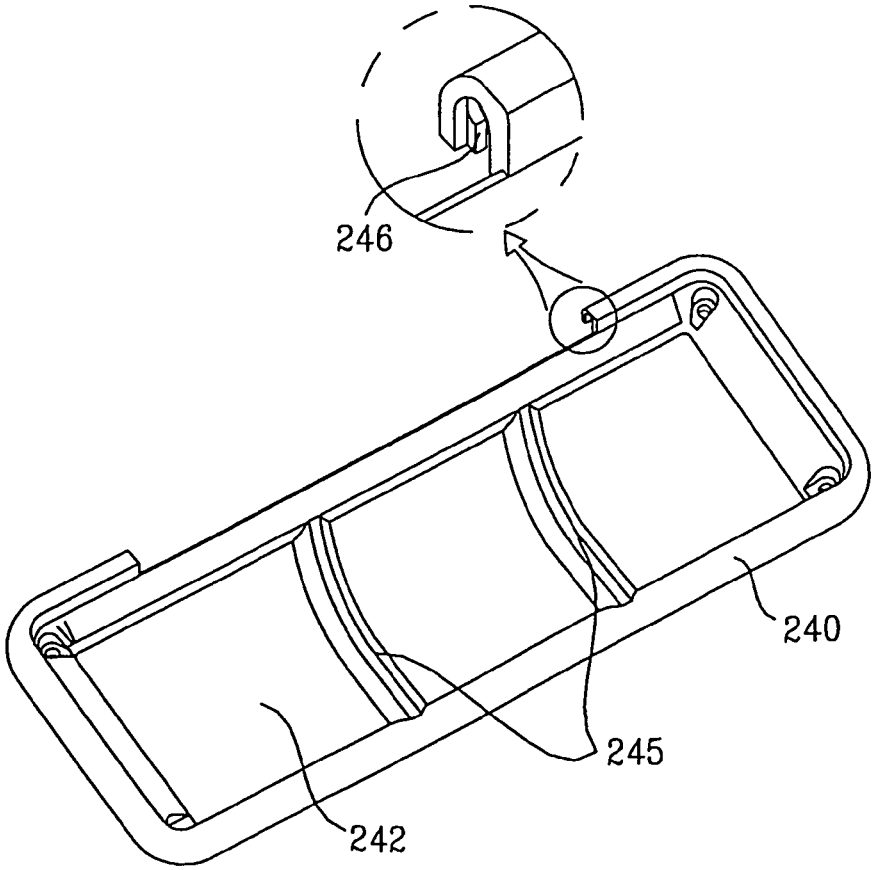
FIG. 24 is a perspective view of the lid frame in FIG. 22.
Figure 25:
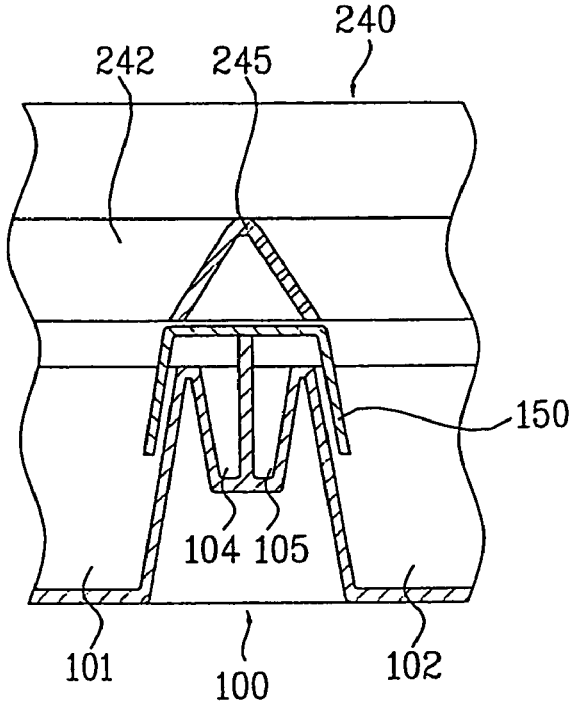
FIG. 25 is a sectional view along II-II line in FIG. 22.

FIGS. 19 to 21 illustrate a detergent supplying apparatus according to a yet another alternative embodiment of the invention. An additive supplying box 340 of this embodiment has a body 341 which is divided into two parts 342 and 343 via a partition 349 so that two different types of additives can be supplied at the same time. Siphon tubes 345 having siphon holes 347 are respectively provided in rear portions of the divided parts 342 and 343.

One of the divided parts 342 and 343 is provided with an insertion recess 344 which is inserted into a fixing protrusion 161 projected from a box seating section 160.

The partition 349 may be provided as high as the main body 341. However, as shown in FIG. 21, the partition 349 is made slightly higher than the main body 341 and a fitting piece 45 is projected downward from inside a lead frame 40 to contact with an upper end of the partition 349 in movement of the main body 341, thereby preventing separation of the additive supplying box 340 owing to vibration during washing and dewatering.

FIGS. 22 to 25 specifically illustrate an embodiment of a lid and a lid frame for opening/closing a detergent container of a detergent supplying apparatus of the invention. A detergent container 100 is installed in an upper end of the top plate 2 of the washer and has a main detergent pool 101 and a preliminary detergent pool 102 which is separately partitioned from the main detergent pool 101. A box-shaped lid frame 240 is arranged along upper peripheries of the detergent container 100, and a lid 50 is rotatably mounted on a lateral portion of the lid frame 240 for opening/closing an upper portion of the detergent container 100.

The lid 50 integrally has a hinge shaft portion 53 in a lateral portion, which has hinge protrusions 55 projected from both ends thereof and rotatably coupled with the lid frame 240.

A handle 52 is convexly formed opposite the hinge shaft portion 53 of the lid 50 so that a user can put a finger and the like into the handle 52 to readily pivot and open the lid 52.

The lid frame 240 has hinge receiving recesses 246 into which the both hinge protrusions 55 of the lid 50 are inserted and engaged and two reinforcing frames 245 which cross an opened portion 242 of the lid frame 240.

Each of the reinforcing frames 245 is formed in a substantially identical position with a pool cover 150 to reinforce the strength thereof. As particularly shown in FIG. 25, the each reinforcing frame 245 is shaped as a triangle, which widens as approaching a lower end from an upper end, to facilitate input of detergent into each of detergent pools 101 to 103.

That is to say, since the reinforcing frames 245 widen as they approach the lower ends, detergent or additive such as tanning/bleaching agent dropping onto the reinforcing frames can be guided into the detergent pools without adhering to the reinforcing frames 245.

Figure 26:
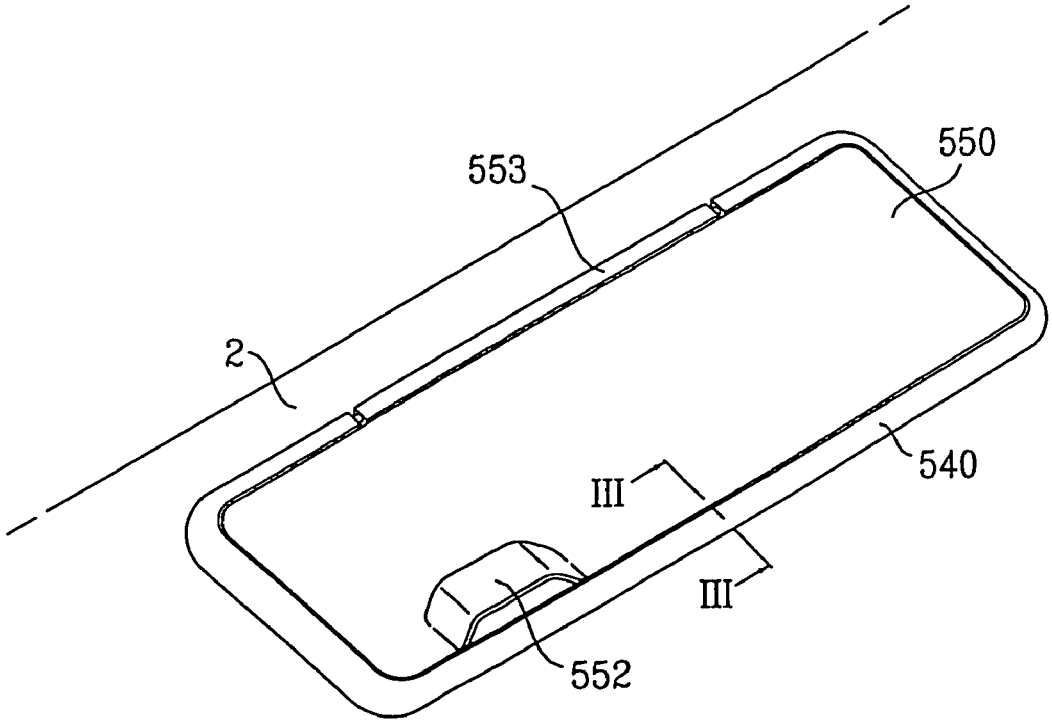
FIG. 26 is a perspective view of an alternative embodiment of a lid and a lid frame in a detergent supplying apparatus of the invention.
Figure 27:
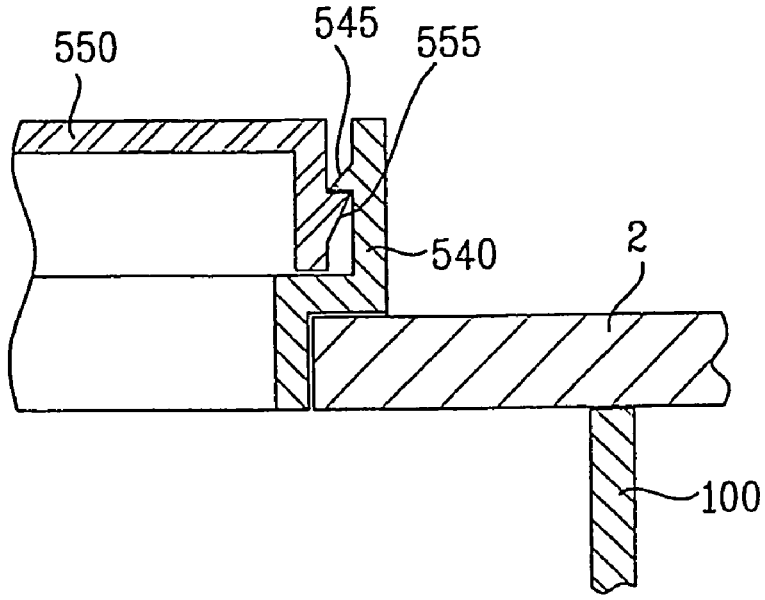
FIG. 27 is a sectional view along III-III line in FIG. 26 illustrating a fixing position between the lid and the lid frame in FIG. 26.

FIGS. 26 and 27 illustrate an alternative embodiment of the above lid and lid frame, in which a lid 550 is engaged with a lid frame 540 to shut a detergent container 100.

As shown in FIGS. 26 and 27, the lid 550 and the lid frame 540 of this embodiment are so constructed to prevent shaking of the lid 550 owing to vibration during washing and dewatering, in which a first coupling protrusion 555 is formed in the shape of a right-angled triangle in an edge portion of the lid 550 and a second coupling protrusion 545 is formed in an edge portion of the lid frame 540 to correspondingly engage into the first coupling protrusion 555.

When the lid 550 is pushed to shut the lid frame 540, an inclined portion of the first coupling protrusion 555 slides over an inclined portion of the second coupling protrusion 545 while pushing the same so that a right-angled face of the first coupling protrusion 555 is engaged into a right-angled face of the second coupling protrusion 545. Through engagement of the first coupling protrusion 555 of the lid 550 into the second coupling protrusion 545 of the lid frame 540, the lid 550 can be detachably fixed to the lid frame 540.

When the user 552 grips and draws a handle 552 in order to open the lid 550, those engaged portions of the lid 550 and the lid frame 540 slide from each other so as to release engagement between the first and second coupling protrusions 555 and 545 thereby freeing the lid 550.

Figure 28:
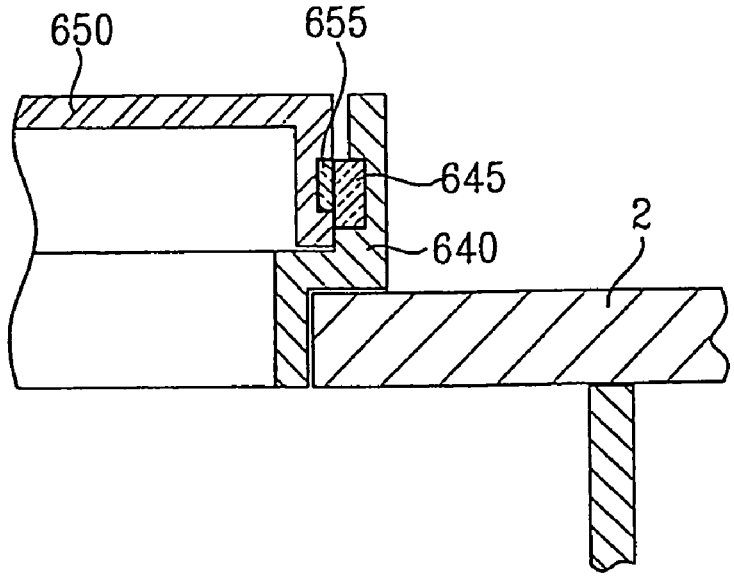
FIG. 28 is a sectional view of an alternative embodiment of the lid and the lid frame shown in FIG. 27.

In the meantime, as shown in FIG. 28 different from the foregoing embodiment, a first magnetic member 655 is mounted on an edge portion of the lid 650 and a second magnetic member 645 is mounted on a lid frame 640 and correspondingly coupled with the first magnetic member 655 so that the lid 650 can be fixed to the lid frame 640. As not particularly described, the lid can be simply fixed to and released from the lid frame by suitably constructing other known coupling means.

Figure 29:
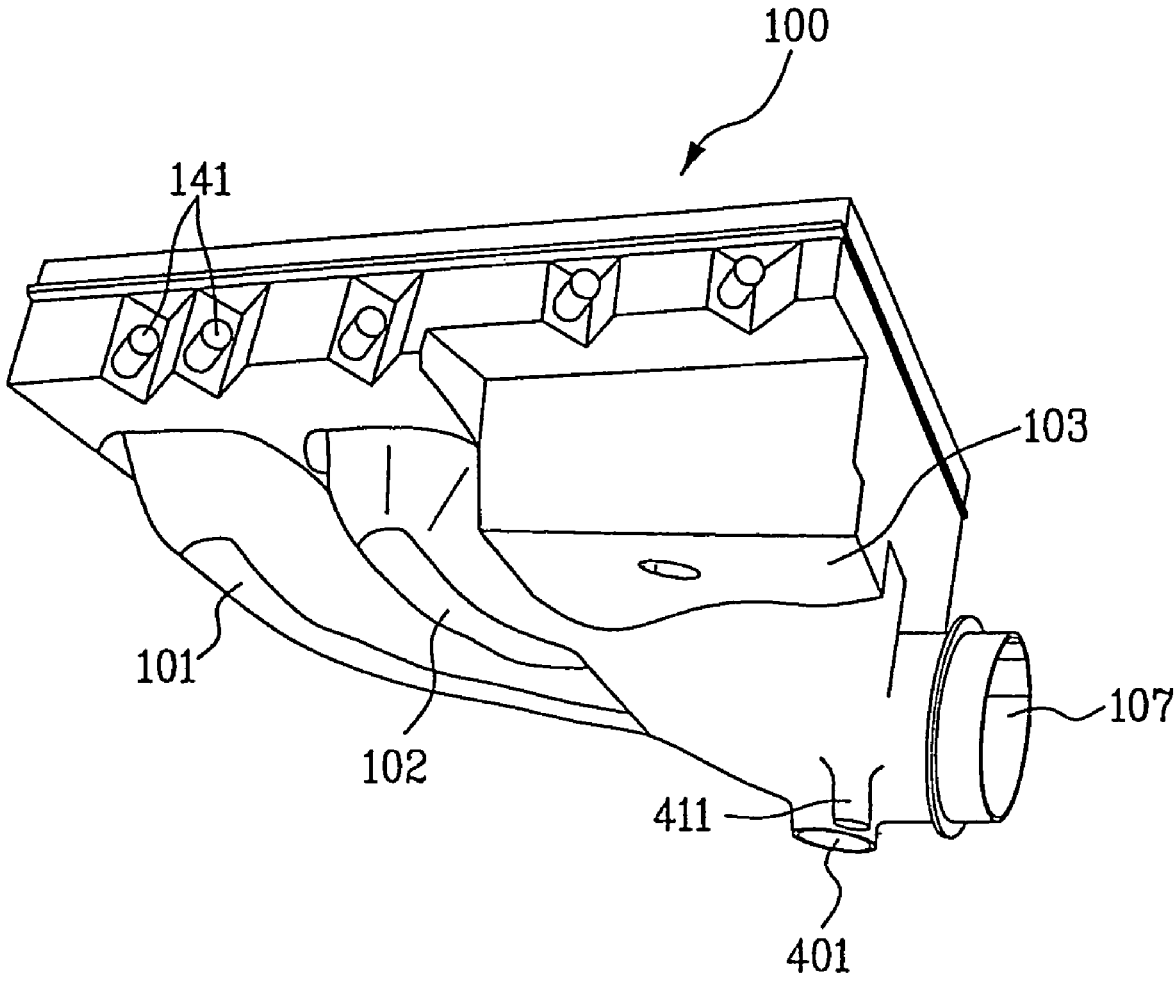
FIG. 29 is a perspective bottom view of a detergent supplying apparatus according to yet another alternative embodiment of the invention.
Figure 30:
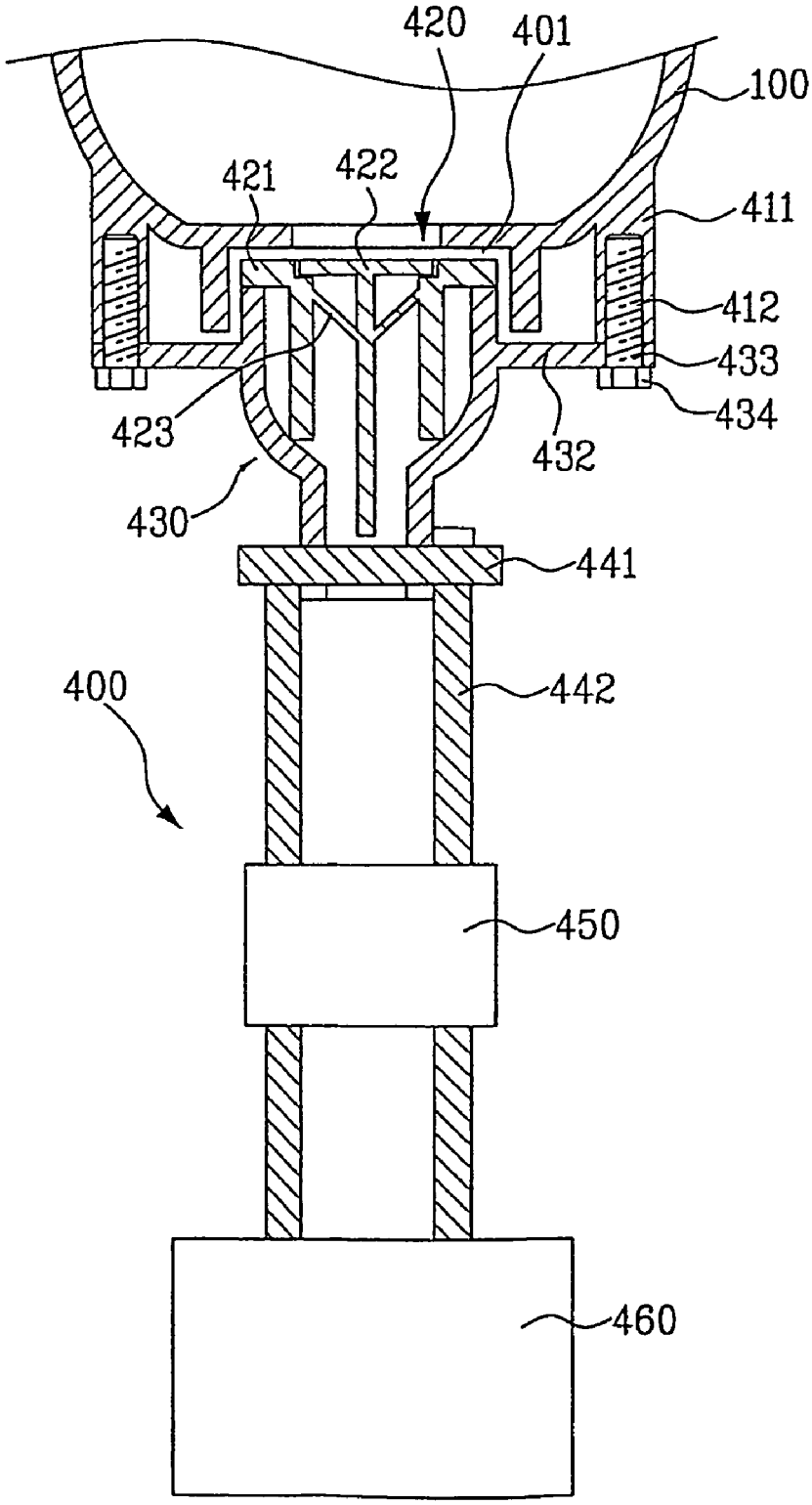
FIG. 30 is a sectional view of important parts of the detergent supplying apparatus in FIG. 29.

FIG. 29 illustrates a detergent supplying apparatus according to a yet another embodiment of the invention. The detergent supplying apparatus of this embodiment is adapted to supply liquid detergent into a detergent container 100 from a lower portion of the detergent container 100.

Like the foregoing embodiments, the detergent supplying apparatus of this embodiment has a detergent container 100 which is partitioned into three detergent pools for storing powder detergent, i.e., a main detergent pool 101, a preliminary detergent pool 102 and an additive pool 102. Water inlet openings 141 are provided in a lateral portion of the detergent container 100 for feeding water respectively to water storage pools (not shown), and a drain 107 is provided in another lateral portion of the detergent container 100 for discharging detergent and washing water.

The detergent container 100 has a feed hole 401 in a lower portion adjacent to the drain 107 for supplying liquid detergent, and a liquid detergent supplying means 400 is installed for supplying liquid detergent via the feed hole 401.

A boss 411 is provided adjacent to the feed hole 401 with a coupling hole for coupling the liquid detergent supplying means 400 to the detergent container 100.

The liquid detergent supplying means 400 includes a liquid detergent storage tank 460 for receiving liquid detergent, a pump 450 for pumping liquid detergent within the liquid detergent storage tank 460, an adapter 430 connected to the feed hole 401 for guiding liquid detergent pumped by the pump 450 to a discharge port, and a check valve 420 installed within the adapter 430 for regulating flow of liquid detergent exclusively toward the detergent container 100 while preventing curing of liquid detergent.

The liquid detergent storage tank 460, the pump 450 and the adapter 430 are connected via a connecting hose 442, and a lower end of the adapter 430 is connected to an upper end of the connecting hose 442 via a clamp 441.

The adapter 430 has a fixed end 432 projected in an outer periphery, which has a fastening hole 433 corresponding to a fastening hole 412 of the boss 411. A bolt 434 is inserted through and fastened to the fastening hole 412 of the boss 411 and the fastening hole 433 of the fixed end 432 so as to fix the adapter 430 to the lower portion of the detergent container 100.

The check valve 420 includes a hollow cylindrical valve body 421 installed within the adapter 430, a valve portion 422 installed within a hollow portion of the valve body 421 in a vertically movable manner for opening/closing an upper end of the hollow portion of the valve body. 421 and an elastic portion 423 for providing a downward elastic force to the valve portion 422 and elastically supporting the valve portion 422.

To supply liquid detergent with the detergent supplying apparatus having the above construction, operation of the pump 450 introduces liquid detergent stored in the liquid detergent storage tank 460 along the connecting hose 442 into the check valve 420 within the adapter 430, and then liquid detergent overcomes the elastic force of the elastic portion 423 to upwardly shift the valve portion 422.

The feed hole 401 is opened simultaneously with the upper end of the hollow upper portion of the valve body 421 via upward shift of the valve portion 422 as above so that liquid detergent flows into the detergent container 100 via the feed hole 401. Then, liquid detergent is introduced via the drain 107 into the tub 3 (refer to FIG. 2) on water flowing along the detergent container 100.

When supply of liquid detergent by the pump 450 is stopped, the valve portion 422 restores to its original position under the elastic force of the elastic portion 423 to shut the upper end of the hollow portion of the valve body 421, thereby preventing powder detergent and/or washing water from flowing into the adapter 430 and the connecting hose 442 as well as sealing the inside of the liquid detergent supplying means 400 so that liquid detergent is not cured.

As set forth above, instead of injecting or directly feeding water into a detergent containing region, the present invention primarily feeds water to the water storage pool and then floods the detergent containing region with water to supply detergent into the tub, thereby avoiding scattering of water from the detergent supplying apparatus to surroundings. Therefore, a fixed quantity of detergent can be supplied into the tub while the detergent supplying apparatus can be maintained clean.

Since water can be mostly discharged from the water storage pool via the slits for discharging the remaining quantity of water, water does not remain in the detergent supplying apparatus, thereby advantageously preventing the remaining water from rotting or freezing in winter and thus damaging the apparatus.

Further, during supply of detergent and washing water into the tub, air is exhausted from the tub via the vent bellows pipe to the detergent supplying apparatus to prevent pressure elevation within the tub, thereby obtaining an advantage that detergent and washing water can be efficiently supplied.

Also, additive detergent such as tanning and/or bleaching agent can be separately supplied to the detergent supplying apparatus so that various washing operations can be automatically performed, thereby improving convenience of a user. In addition, since liquid detergent can be readily supplied from a lower portion of the detergent supplying apparatus by using the liquid detergent supplying means, desired detergent can be supplied at a proper time, thereby further improving washing efficiency.

Moreover, the detergent supplying apparatus is fixed to the upper top plate of the cabinet to supply detergent to obtain advantages in that the detergent supplying apparatus is simplified in design and readily performs a detergent input operation.

INDUSTRIAL APPLICABILITY

Although the detailed description has been made about the detergent supplying apparatus of the present invention adopted to a drum type washer, it is construed that the present invention is not restricted to the above description. In addition to the foregoing drum type washer, however, the present invention may be applied in a substantially identical manner to all types of washers such as a washer having a drum rotating about a vertical axis.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A detergent supplying apparatus in a washer including a cabinet, a drum rotatably provided in the cabinet and a tub fixedly installed outside the drum, the apparatus comprising:

a water feed pipe for feeding water;

a detergent container including a water storage pool having a water inlet opening connected to the water feed pipe, for being supplied with water through the water inlet opening, a detergent pool dividedly formed at a side of the water storage pool by an overflow wall, for storing detergent, and a drain provided at a passage end of the detergent pool, whereby the water fed to the water storage pool overflows the overflow wall to be fed to the detergent pool, and then discharges through the drain;

a detergent discharge pipe of which one end is connected to the drain of the detergent container and the other end is connected to the tub of the washer, for guiding the detergent and water discharged through the drain into the tub;

a condensing pool provided in a corner portion of the detergent container and divided from the water storage pool and the detergent pool via a partition; and a guide duct having one end connected to the tub and the other end connected to a connecting pipe fixed to an upper lateral side of the condensing pool, for guiding air from the tub to the condensing pool.

2. The detergent supplying apparatus of claim 1, wherein the detergent container is provided in an upper surface of the cabinet in an outwardly openable manner.

3. The detergent supplying apparatus of claim 2, further comprising a lid for opening/closing the detergent container.

4. The detergent supplying apparatus of claim 3, wherein the lid is pivotably provided in the upper face of the cabinet.

5. The detergent supplying apparatus of claim 4, further comprising a lid frame configured to surround upper peripheries of the detergent container and with which the lid is pivotably coupled.

6. The detergent supplying apparatus of any of claims 3 to 5, further comprising a handle provided in one side of the lid.

7. The detergent supplying apparatus of claim 3 or 4, further comprising fixing means for fixing the lid when the detergent container is shut by the lid.

8. The detergent supplying apparatus of claim 5, further comprising fixing means for fixing the lid when the detergent container is shut by the lid.

9. The detergent supplying apparatus of claim 8, wherein the fixing means comprises:

a first coupling protrusion provided in an edge of the lid; and a second coupling protrusion provided in the lid frame and detachably coupled with the first coupling protrusion in a corresponding manner.

10. The detergent supplying apparatus of claim 8, wherein the fixing means comprises:

a first magnetic member provided in an edge of the lid; and a second magnetic member provided in the lid frame and correspondingly coupled with the first magnetic member.

11. The detergent supplying apparatus of claim 1, wherein the overflow wall of the detergent container has a plurality of slits formed at an upper edge thereof.

12. The detergent supplying apparatus of claim 1, wherein the overflow wall has a slit which is cut out from an upper end to a lower end of the overflow wall, for discharging a remaining quantity of water.

13. The detergent supplying apparatus of claim 1, further comprising a pool cover which is provided to cover an upper portion of the water storage pool maintain a gap from an upper edge of the overflow wall of the detergent container.

14. The detergent supplying apparatus of claim 1, further comprising a dispersion rib projected from a lower face of the water storage pool, for dispersing water, which is dispersed through the water inlet opening, in an upward or lateral direction.

15. The detergent supplying apparatus of claim 14, wherein the dispersion rib is L-shaped.

16. The detergent supplying apparatus of claim 1, further comprising a filtering member in the form of a net which is provided in the drain of the detergent container.

17. The detergent supplying apparatus of claim 1, wherein the detergent pool is divided into a plurality of pools.

18. The detergent supplying apparatus of claim 17, wherein the water storage pool is separately defined into a plurality of pools by a plurality of partitions so as to feed water to each of the detergent pools.

19. The detergent supplying apparatus of claim 17, wherein the detergent pool is separately partitioned into three parts of first to third detergent pools, in sequence on the basis of the drain of the detergent container.

20. The detergent supplying apparatus of claim 19, wherein the first and second detergent pools define a U-shaped passage with two U-shaped overflow walls, and wherein the water storage pool is separately partitioned into first to third water storage pools by a plurality of partitions which extend from one end of the water storage pool to ends of the overflow walls, the first water storage pool corresponding to the first detergent pool, the second water storage pool corresponding to the second detergent pool, and the third storage pool corresponding to the third detergent pool.

21. The detergent supplying apparatus of any of claims 17 to 20, wherein each of the overflow walls have a plurality of slits formed at an upper edge.

22. The detergent supplying apparatus of any of claims 17 to 20, wherein each of the overflow partitions have a plurality of slits for discharging remaining water, the slits being cut out from an upper end to a lower end of the each overflow partition.

23. The detergent supplying apparatus of any of claims 17 to 20, further comprising dispersion ribs each projected from a lower portion of each of the water storage pools, for dispersing water, which is dispersed through the water inlet opening, in an upward or lateral direction.

24. The detergent supplying apparatus of claim 23, wherein the each dispersion rib is L-shaped.

25. The detergent supplying apparatus in accordance with any of claims 17 to 20, further comprising a filtering member in the form of a net which is provided in the drain of the detergent container.

26. The detergent supplying apparatus of claim 20, further comprising a pool cover provided to cover upper portions of the first to third water storage pools while maintaining a certain gap from an upper edge of each of the overflow walls of the detergent container.

27. The detergent supplying apparatus of claim 26, wherein the pool cover has coupling ribs in a lower face, the coupling ribs being coupled to upper edges of the partitions.

28. The detergent supplying apparatus of claim 26 or 27, wherein the pool cover has anti-scattering ribs projected from a lower face of the pool cover adjacent to the overflow wall to prevent scatting of water which is fed from the water storage pools to the detergent pools.

29. The detergent supplying apparatus of claim 28, wherein the anti-scattering ribs are projected with lower ends higher than the upper edges of the overflow walls.

30. The detergent supplying apparatus of claim 28, wherein the anti-scattering ribs are projected with lower ends lower than the upper edges of the overflow walls.

31. The detergent supplying apparatus of any of claims 1 and 17 to 20, further comprising a protrusion provided on a bottom of the detergent pool, for guiding a water flow to a region where detergent is collected.

32. The detergent supplying apparatus of claim 20, wherein the first detergent pool has a passage end higher than that of the second detergent pool.

33. The detergent supplying apparatus of claim 20, further comprising a lid for opening/closing the detergent container.

34. The detergent supplying apparatus of claim 33, wherein the lid is pivotably equipped in an upper end of the cabinet for opening/closing the detergent container.

35. The detergent supplying apparatus of claim 34, further comprising a lid frame surrounding upper peripheries of the detergent container and pivotably coupled with the lid.

36. The detergent supplying apparatus of any of claims 33 to 35, further comprising a handle provided in a portion of the lid.

37. The detergent supplying apparatus of claim 33 or 34, further comprising fixing means for fixing the lid when the detergent container is shut by the lid.

38. The detergent supplying apparatus of claim 35, further comprising fixing means for fixing the lid when the detergent container is shut by the lid.

39. The detergent supplying apparatus of claim 38, wherein the fixing means includes:

a first coupling protrusion provided in an edge of the lid; and a second coupling protrusion provided in the lid frame and detachably coupled with the first coupling protrusion in a corresponding manner.

40. The detergent supplying apparatus of claim 38, wherein the fixing means includes:

a first magnetic member provided in an edge of the lid; and a second magnetic member provided in the lid frame and correspondingly coupled with the first magnetic member.

41. The detergent supplying apparatus of any of claims 1 and 17 to 20, further comprising:

a box seating section provided integral with a portion of the detergent pool; and a detachable additive supplying box seated on the box seating section.

42. The detergent supplying apparatus of claim 41, wherein the additive supplying box includes:

a main body with an opened upper face:

a discharge member provided in a portion of the main body, for discharging water and detergent which is fed into the main body; and a position fixing means for fixing the main body on the detergent pool.

43. The detergent supplying apparatus of claim 42, wherein the discharge member includes a siphon tube and a siphon cover which are provided in a corner within the main body.

44. The detergent supplying apparatus of claim 41, wherein the box seating section has a projected jaw for seating a lower portion of the additive supplying box to have a certain degree of play between the additive supplying box and the box seating section.

45. The detergent supplying apparatus of claim 42, wherein the position fixing means includes:

a fixing protrusion projected from a lower portion of the detergent pool; and an insertion recess provided in a lower portion of the box body and into which the fixing protrusion is inserted.

46. The detergent supplying apparatus of claim 45, wherein the fixing protrusion has a width smaller than that of the insertion recess.

47. The detergent supplying apparatus of claim 45, wherein the position fixing means includes:

a first inclined portion formed in a portion of the main body; and a second inclined portion formed in a portion of the detergent pool and tightly contacting with the first inclined portion in a corresponding manner.

48. The detergent supplying apparatus of claim 42, wherein the discharge member is positioned outside the box seating section.

49. The detergent supplying apparatus of claim 42, wherein the lower portion of the main body is downwardly inclined toward the discharge member.

50. The detergent supplying apparatus of claim 49, wherein the main body has a rib formed at the lower portion thereof and opposite to the discharge member, the rib being projected outwardly and downwardly for compensating inclination.

51. The detergent supplying apparatus of claim 42, wherein the lower portion of the main body is horizontally provided parallel to the box seating section.

52. The detergent supplying apparatus of claim 42, wherein the main body has an inside which is divided into a plurality of compartments by a partition, and the discharge members are separately provided each of the compartments.

53. The detergent supplying apparatus of claim 52, wherein the partition is higher than the main body.

54. The detergent supplying apparatus of claim 53, further comprising a lid frame surrounding upper peripheries of the detergent container, the lid frame having a fitting rib which is projected downward to catch and support an edge in an end of the partition when the main body shakes.

55. The detergent supplying apparatus of claim 5 or 35, wherein the lid has a hinge shaft portion in a lateral portion, and wherein the lid frame has a hinge receiving portion into which the hinge shaft is rotatably inserted.

56. The detergent supplying apparatus of claim 5 or 35, wherein the lid frame has a plurality of reinforcing frames crossing an open portion of the lid frame.

57. The detergent supplying apparatus of claim 56, wherein the reinforcing frames has a section of which width widens as it travels to a lower end from an upper end.

58. The detergent supplying apparatus of claim 1, wherein the guide duct includes:

a vent bellows pipe having one end connected to the tub and the other end connected to the connecting pipe; and an air duct having one end connected to the vent bellows pipe and the other end connected with the condensing pool via the connecting pipe.

59. The detergent supplying apparatus of claim 58, wherein the air duct is reverse U-shaped.

60. The detergent supplying apparatus of claim 59, further comprising a pair of fixing pieces for fixedly supporting the air duct to a corner of the detergent container.

61. The detergent supplying apparatus of claim 1, further comprising a communication passage between the condensing pool and the detergent pool such that water flows over from the condensing pool to the detergent pool.

62. The detergent supplying apparatus of claim 1, wherein the compartment has a slit for feeding water in an upper end.

63. The detergent supplying apparatus of any of claims 1 and 17 to 20, further comprising a liquid detergent supplying means provided in a portion of the detergent container for automatically supplying liquid detergent into the detergent pool.

64. The detergent supplying apparatus of claim 63, wherein the liquid detergent supplying means is adapted to supply liquid detergent to the detergent pool in a lower portion of the detergent container.

65. The detergent supplying apparatus of claim 63, wherein the liquid detergent supplying means comprises:

a feed hole provided in a bottom of the detergent pool;

a storage tank for storing liquid detergent;

a pump for pumping liquid detergent from the liquid detergent storage tank to the feed hole;

an adapter for connecting between the feed hole and the pump; and a check valve provided in the adapter for regulating flow from the detergent pool toward a lower portion of the feed hole.

66. The detergent supplying apparatus of claim 65, wherein the check valve includes:

a hollow cylindrical valve body inserted into the adapter;

a valve portion provided vertically movable within a hollow portion of the valve body for opening/closing an upper end of the hollow portion of the valve body; and an elastic member for providing the valve portion with a downward elastic force to elastically support the valve portion.

67. The detergent supplying apparatus of claim 65, further comprising a fixing means provided in an underside of the detergent container for fixedly supporting the adapter.

68. The detergent supplying apparatus of claim 67, wherein the fixing means includes:

a fastening boss provided in the underside of the detergent container;

a fixing plate outwardly projected from an outer periphery of the adapter and having a coupling hole corresponding to the fixing boss; and a bolt fastening into the coupling hole of the fixing plate and the fastening boss.

* * * * *